US008498563B2

(12) United States Patent
Baba et al.

(10) Patent No.: US 8,498,563 B2
(45) Date of Patent: Jul. 30, 2013

(54) FIXING DEVICE, HEATING DEVICE, AND IMAGE FORMING APPARATUS

(75) Inventors: Motofumi Baba, Kanagawa (JP); Hideaki Ohhara, Kanagawa (JP); Masayoshi Nakao, Kanagawa (JP); Yasunori Fujimoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 159 days.

(21) Appl. No.: 13/219,129

(22) Filed: Aug. 26, 2011

(65) Prior Publication Data

US 2012/0224895 A1 Sep. 6, 2012

(30) Foreign Application Priority Data

Mar. 3, 2011 (JP) ..... 2011-046071

(51) Int. Cl.
*G03G 15/20* (2006.01)

(52) U.S. Cl.
USPC ..... 399/330; 219/216

(58) Field of Classification Search
USPC ..... 399/328, 329, 330, 335; 219/216, 219/619
See application file for complete search history.

(56) References Cited

U.S. PATENT DOCUMENTS

| | | | | |
|---|---|---|---|---|
| 7,725,065 | B2 * | 5/2010 | Baba et al. | 399/328 |
| 2009/0290916 | A1 | 11/2009 | Baba | |
| 2012/0321333 | A1 * | 12/2012 | Baba | 399/69 |

FOREIGN PATENT DOCUMENTS

| | | | |
|---|---|---|---|
| JP | 2000162913 A | * | 6/2000 |
| JP | 2002-182503 A | | 6/2002 |
| JP | 2004-177745 A | | 6/2004 |
| JP | 2006267195 A | * | 10/2006 |

* cited by examiner

*Primary Examiner* — Robert Beatty
(74) *Attorney, Agent, or Firm* — Sughrue Mion, PLLC

(57) ABSTRACT

A fixing device includes a fixing member that has a conductive layer capable of being heated by electromagnetic induction and fixes an image to the recording material; a magnetic-field generator that generates an alternating magnetic field intersecting with the conductive layer of the fixing member; a heating member that is at least partly separated from the fixing member and is heated; and a deformable member that is deformed when receiving heat and moves the heating member toward the fixing member.

10 Claims, 18 Drawing Sheets

FIG. 17

| | HEAT-GENERATION RATIO | | TIME UNTIL FIXING IS ABLE TO BE STARTED |
|---|---|---|---|
| | FIXING BELT | TEMPERATURE-SENSITIVE MAGNETIC MEMBER | |
| FIXING DEVICE 100 IN FIG. 16 | 10 | 0 | 3 |
| FIXING DEVICE 100 IN FIG. 2 | 7 TO 8 | 2 TO 3 | 4 TO 6 |

FIXING DEVICE, HEATING DEVICE, AND IMAGE FORMING APPARATUS

CROSS-REFERENCE TO RELATED APPLICATIONS

This application is based on and claims priority under 35 USC 119 from Japanese Patent Application No. 2011-046071 filed Mar. 3, 2011.

BACKGROUND

The present invention relates to a fixing device, a heating device, and an image forming apparatus.

SUMMARY

According to an aspect of the invention, there is provided a fixing device including a fixing member that has a conductive layer capable of being heated by electromagnetic induction and fixes an image to the recording material; a magnetic-field generator that generates an alternating magnetic field intersecting with the conductive layer of the fixing member; a heating member that is at least partly separated from the fixing member and is heated; and a deformable member that is deformed when receiving heat and moves the heating member toward the fixing member.

BRIEF DESCRIPTION OF THE DRAWINGS

Exemplary embodiment(s) of the present invention will be described in detail based on the following figures, wherein:

FIG. 17 is an illustration for explaining a heat-generation ratio between the fixing belt and the temperature-sensitive magnetic member etc.

DETAILED DESCRIPTION

An exemplary embodiment of the present invention will be described below with reference to the accompanying drawings.

Figure 1:
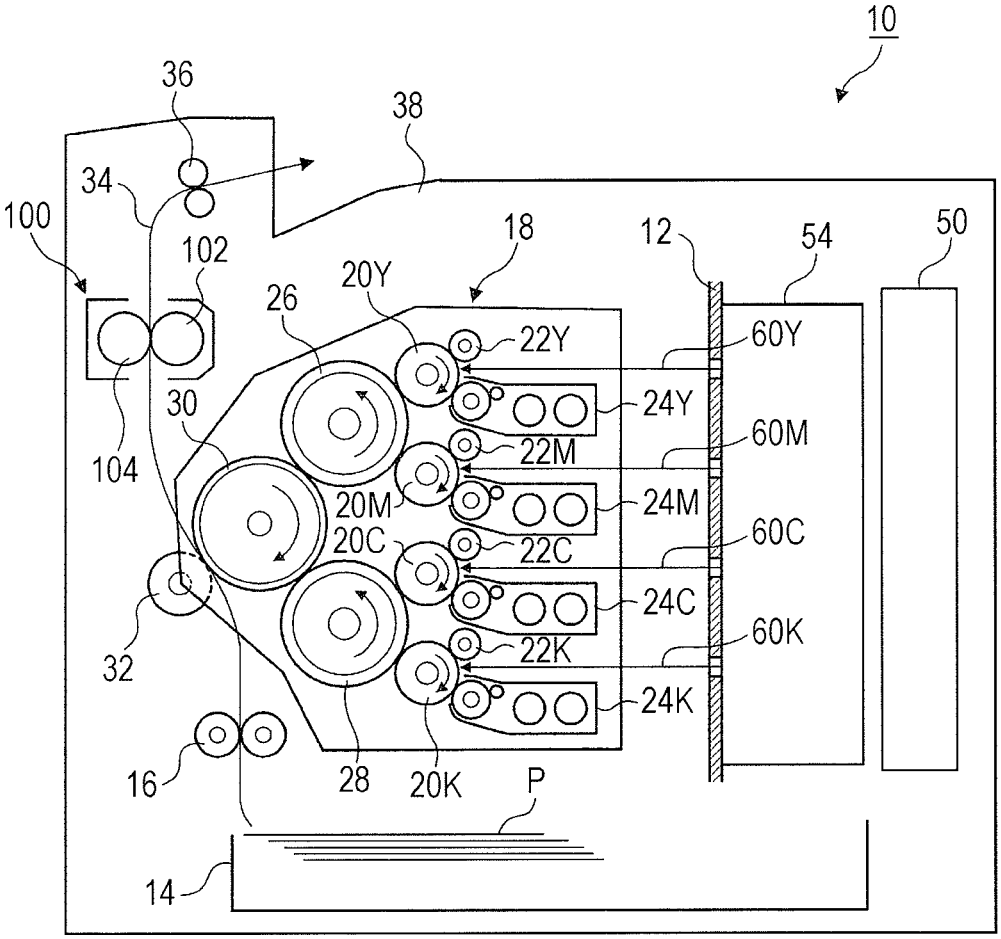
FIG. 1 is an illustration showing a printer according to an exemplary embodiment.

FIG. 1 is an illustration showing a printer 10 according to this exemplary embodiment.

The printer 10 as an example of an image forming apparatus includes a housing 12 that forms a body of the printer 10. The printer 10 includes an optical scanning device 54. The optical scanning device 54 is fixed to the housing 12. The printer 10 includes a control unit 50 provided at a position next to the optical scanning device 54. The control unit 50 controls an operation of the optical scanning device 54 and operations of respective units of the printer 10.

The optical scanning device 54 performs scanning with a light beam emitted from a light source (not shown) by using a rotatable polygonal mirror, reflects the light beam by using plural optical components such as reflection mirrors, and hence emits light beams 60Y, 60M, 60C, and 60K respectively corresponding to toners of yellow (Y), magenta (M), cyan (C), and black (K). The light beams 60Y, 60M, 60C, and 60K are respectively guided to corresponding photoconductor drums 20Y, 20M, 20C, and 20K. In the printer 10 according to this exemplary embodiment, a sheet housing portion 14 is provided in a lower section of the printer 10. The sheet housing portion 14 houses sheets P as an example of a recording material.

Further, a pair of registration rollers 16 is provided above the sheet housing portion 14. The registration rollers 16 adjust the position of a leading edge of a sheet P. Though not shown, a feed roller is provided. The feed roller contacts a top sheet P from among the plural sheets P housed in the sheet housing portion 14, and feeds the sheet P toward the registration rollers 16. In this exemplary embodiment, an image forming unit 18 that functions as part of an image forming device is provided at a center portion of the printer 10. The image forming unit 18 includes the four photoconductor drums 20Y, 20M, 20C, and 20K. The four photoconductor drums 20Y, 20M, 20C, and 20K are arranged in line in a vertical direction.

Charging rollers 22Y, 22M, 22C, and 22K that electrically charge the surfaces of the photoconductor drums 20Y, 20M, 20C, and 20K are provided at the upstream sides in rotation directions of the photoconductor drums 20Y, 20M, 20C, and 20K. Developing devices 24Y, 24M, 24C, and 24K that develop electrostatic latent images formed on the photoconductor drums 20Y, 20M, 20C, and 20K with the toners are provided at the downstream sides in the rotation directions of the photoconductor drums 20Y, 20M, 20C, and 20K. Also, in this exemplary embodiment, a first intermediate transfer member 26 that contacts the photoconductor drums 20Y and 20M, and a second intermediate transfer member 28 that contacts the photoconductor drums 20C and 20K are provided.

Further, a third intermediate transfer member 30 that contacts the first intermediate transfer member 26 and the second intermediate transfer member 28 is provided. A transfer roller 32 is provided at a position at which the transfer roller 32 faces the third intermediate transfer member 30. In this exemplary embodiment, toner images on the photoconductor drums 20Y and 20M are transferred on the first intermediate transfer member 26, and toner images on the photoconductor drums 20C and 20K are transferred on the second intermediate transfer member 28. Then, the toner images transferred on the first intermediate transfer member 26 and the toner images transferred on the second intermediate transfer member 28 are transferred on a sheet P through the third intermediate transfer member 30.

Also, in this exemplary embodiment, a fixing device 100 is provided on a sheet transport path 34 in which a sheet P is transported and is located downstream of the transfer roller 32 in a transport direction of the sheet P. The fixing device 100 includes a pressure roller 104 and a fixing belt 102, which is an example of a fixing member. The fixing device 100 fixes a toner image on a sheet P by heating and pressing the sheet P. The sheet P to which the toner image is fixed is output to a sheet output portion 38 by sheet transport rollers 36. The sheet output portion 38 is provided on the printer 10.

Now, an image formation operation executed by the printer 10 is described.

When the image formation operation is started, the charging rollers 22Y to 22K uniformly electrically charge the surfaces of the photoconductor drums 20Y to 20K. The optical scanning device 54 irradiates the surfaces of the photoconductor drums 20Y to 20K after charging, with the light beams 60Y to 60K in accordance with an output image. Hence, electrostatic latent images corresponding to images of the respective colors are formed on the photoconductor drums 20Y to 20K. The developing devices 24Y to 24K supply toners to the electrostatic latent images. Toner images of the Y color to K color are formed on the photoconductor drums 20Y to 20K.

Then, a magenta toner image is first-transferred on the first intermediate transfer member 26 from the magenta photoconductor drum 20M. A yellow toner image is first-transferred on the first intermediate transfer member 26 from the yellow photoconductor drum 20Y. At this time, the yellow toner image is superposed on the magenta toner image which has been placed on the first intermediate transfer member 26. A black toner image is first-transferred on the second intermediate transfer member 28 from the black photoconductor drum 20K. A cyan toner image is first-transferred on the second intermediate transfer member 28 from the cyan photoconductor drum 20C. At this time, the cyan toner image is superposed on the black toner image which has been placed on the second intermediate transfer member 28.

Then, the magenta and yellow toner images which have been first transferred on the first intermediate transfer member 26 are second-transferred on the third intermediate transfer member 30. Also, the black and cyan toner images which have been first transferred on the second intermediate transfer member 28 are second-transferred on the third intermediate transfer member 30. The magenta and yellow toner images which have been second-transferred first and the cyan and black toner images which have been second-transferred next are superposed on each other on the third intermediate transfer member 30. Accordingly, a full-color toner image with colors (three colors) and black is formed on the third intermediate transfer member 30.

Then, the toner image on the third intermediate transfer member 30 reaches a nip part that is formed by the third intermediate transfer member 30 and the transfer roller 32. In synchronization with this timing, a sheet P is transported by the registration rollers 16 to the nip part. Accordingly, the full-color toner image is third-transferred (finally transferred) on the sheet P. Then, the sheet P is transported to the fixing device 100, and passes through a nip portion that is formed by the fixing belt 102 and the pressure roller 104. At this time, by the effects of heat and pressure provided by the fixing belt 102 and the pressure roller 104, the toner image is fixed to the sheet P. After fixing, the sheet P is output by the sheet transport rollers 36 to the sheet output portion 38. Thus, the image formation on the sheet P is completed.

Now, the fixing device 100 is described in detail.

Figure 2:
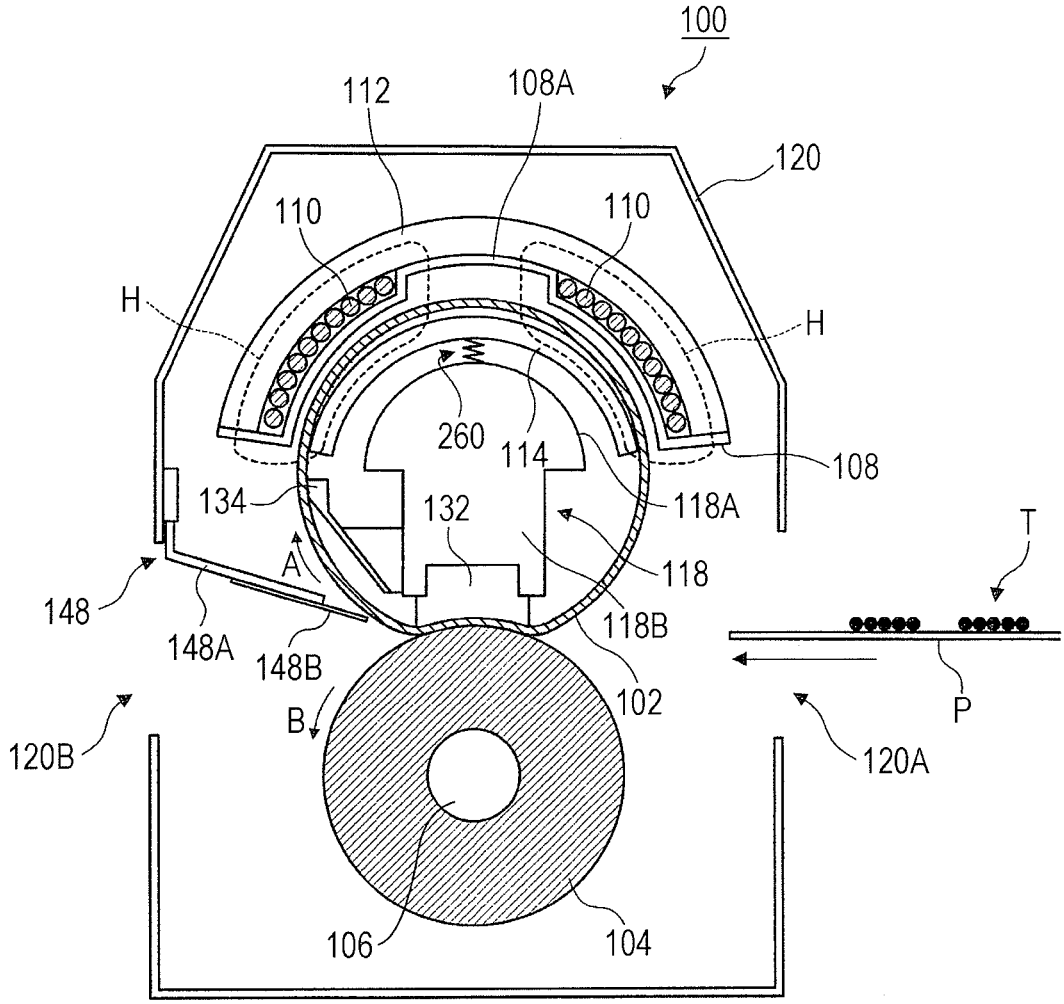
FIG. 2 is an illustration for explaining a fixing device.
Figure 3:
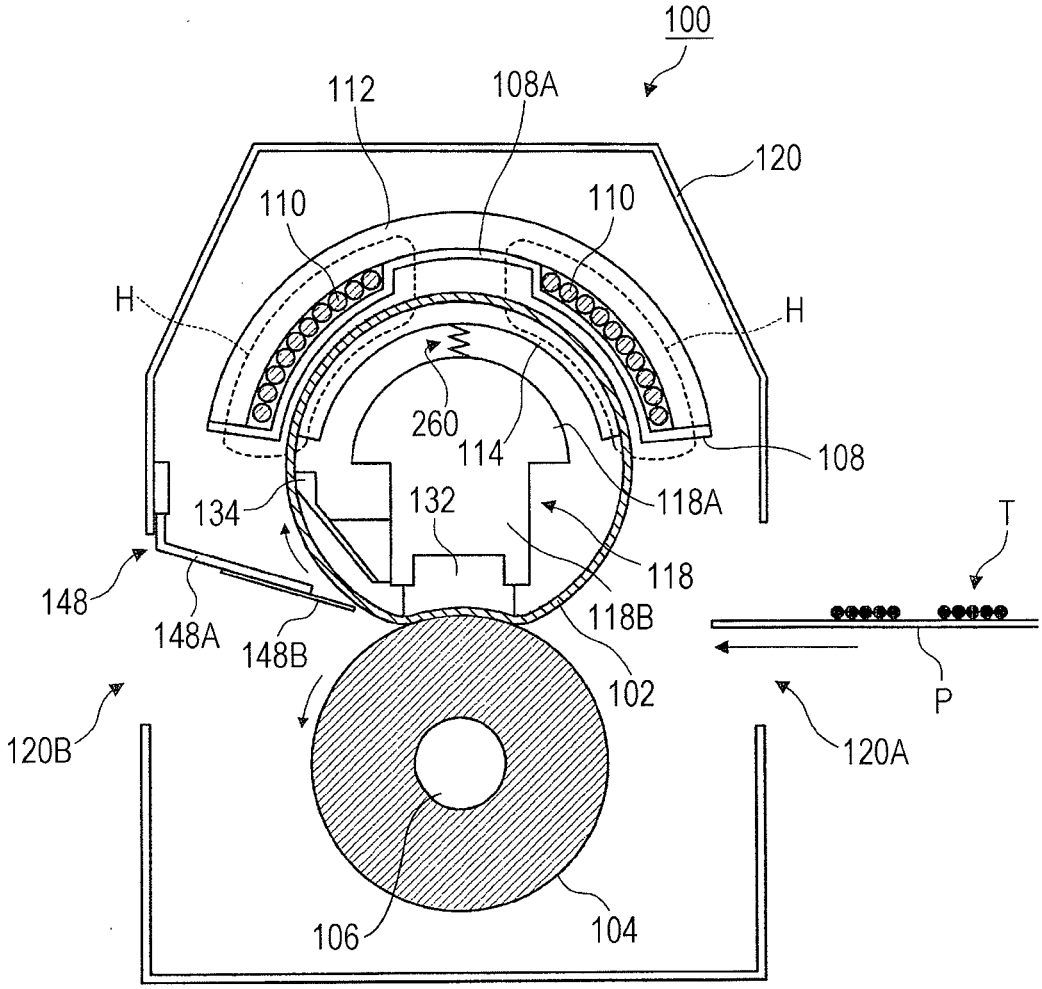
FIG. 3 is an illustration for explaining the fixing device.
Figure 4:
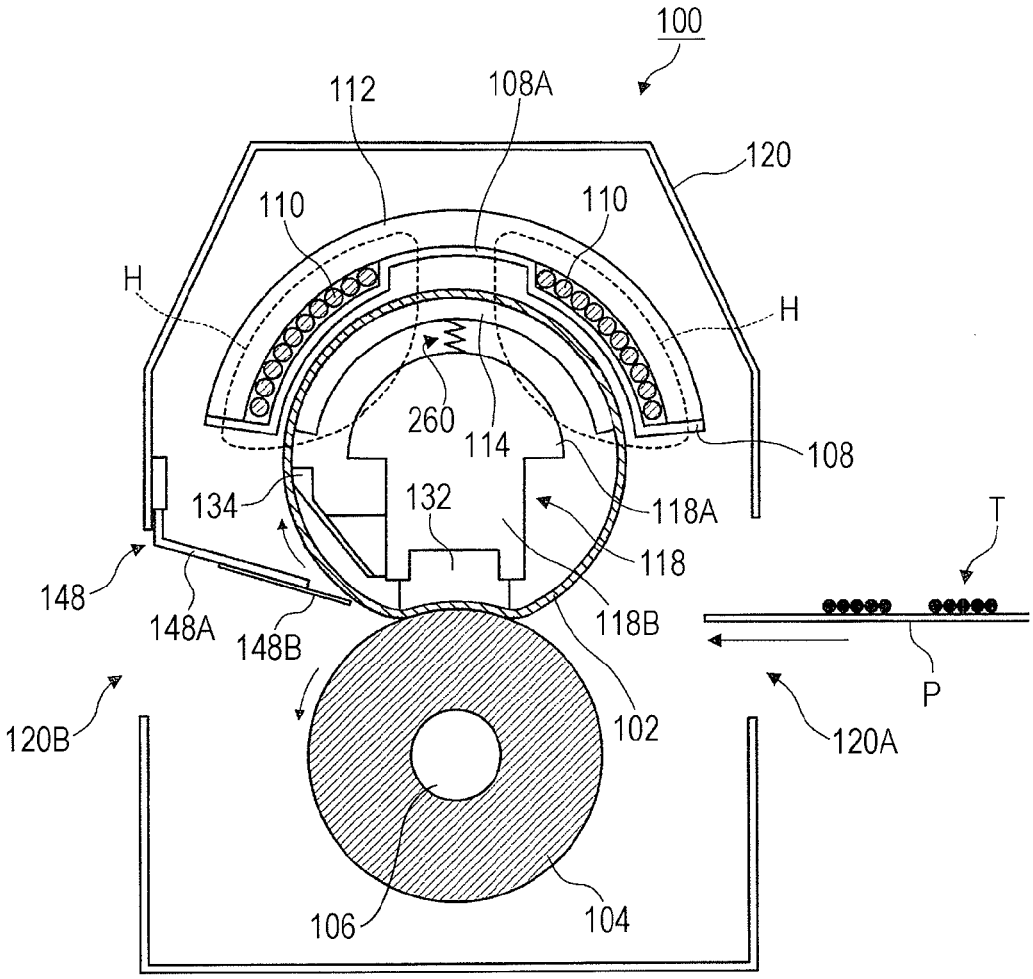
FIG. 4 is an illustration for explaining the fixing device.

FIGS. 2 to 4 are illustrations for explaining the fixing device 100.

As shown in FIG. 2, the fixing device 100 includes a housing 120. The housing 120 has a first opening 120A through which a transported sheet P enters, and a second opening 120B through which a sheet P after fixing processing is output. Also, the fixing device 100 includes the fixing belt 102 that is a cylindrical or substantially cylindrical endless belt. The fixing belt 102 is rotatable in a direction indicated by arrow A in the drawing around a center axis extending in the longitudinal direction of the fixing belt 102.

A bobbin 108 is arranged at a position at which the bobbin 108 faces the outer peripheral surface of the fixing belt 102. The bobbin 108 is formed of an insulating material. The bobbin 108 has an arc shape to extend along the outer peripheral surface of the fixing belt 102. The bobbin 108 has a protrusion 108A at a center portion of a surface opposite to a surface that faces the fixing belt 102. The distance between the bobbin 108 and the fixing belt 102 is in a range from about 1 to 3 mm. An exciting coil 110 (example of a magnetic-field generator) that generates a magnetic field (alternating magnetic field) H is wound around the protrusion 108A of the bobbin 108 in the axial direction (in a depth direction of FIG. 2). A magnetic-material core 112 is arranged at a position at which the magnetic-material core 112 faces the exciting coil 110. The magnetic-material core 112 has an arc shape extending along the shape of the bobbin 108.

Now, a configuration of the fixing belt 102 is described.

Figure 5A:
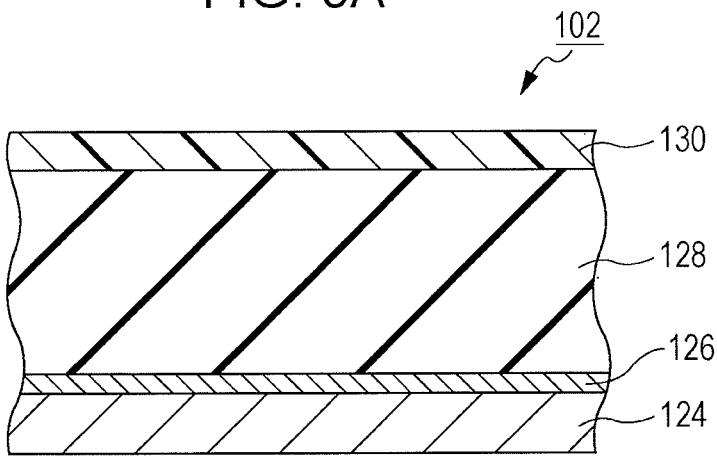
FIGS. 5A and 5B are illustrations showing a cross-sectional configuration etc. of a fixing belt.
Figure 5B:
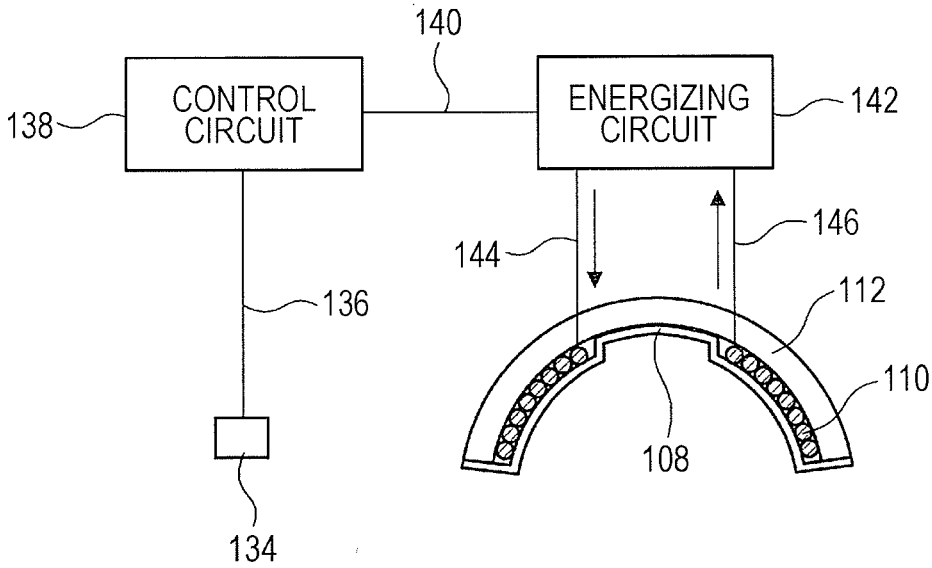

FIGS. 5A and 5B are illustrations showing a cross-sectional configuration etc. of the fixing belt 102. As shown in FIG. 5A, the fixing belt 102 includes a base layer 124, a heat-generating layer 126, an elastic layer 128, and a release layer 130. The base layer 124, the heat-generating layer 126, the elastic layer 128, and the release layer 130 are provided in that order from the inner peripheral surface side toward the outer peripheral surface side of the fixing belt 102. The fixing belt 102 of this exemplary embodiment has a diameter of 30 mm, and a length in the longitudinal direction (width direction) of 370 mm.

The base layer 124 may use a material having an intensity that allows the base layer 124 to support the thin heat-generating layer 126. The material is heat-resistant, and does not generate heat or hardly generates heat by an effect of a magnetic field (magnetic flux) although the material passes through the magnetic field. For example, a metal belt (of non-magnetic metal, e.g., non-magnetic stainless steel) with a thickness in a range from 30 to 200 μm (preferably, in a range from 100 to 150 μm), or a belt formed of a metal material, such as Fe, Ni, Co, or an alloy of Fe—Ni—Co, Fe—Cr—Co, or the like, of these metals may be used. Alternatively, a resin belt (for example, polyimide belt) with a thickness in a range from 60 to 200 μm may be used. In either case, the material (specific resistance, relative permeability) and thickness are determined so that the magnetic flux of the exciting coil 110 acts on a temperature-sensitive magnetic member 114 (described later). In this exemplary embodiment, non-magnetic stainless steel is used.

The heat-generating layer 126 that is an example of a conductive layer is formed of a metal material that generates heat by an electromagnetic induction effect in which the magnetic field (alternating magnetic field) H (see FIGS. 2 to 4) generated by the exciting coil 110 pass through the heat-generating layer 126 in the thickness direction and eddy current flows to generate a magnetic field that cancels the magnetic field H. Also, the heat-generating layer 126 has a smaller thickness than a skin depth as a thickness by which the magnetic field H is able to enter, to allow the magnetic flux of the magnetic field H to penetrate through the heat-generating layer 126. When δ is a skin depth, $\rho_n$ is a specific resistance and $\mu_n$ is a relative permeability of the heat-generating layer 126, and f is a frequency of a signal (current) in the exciting coil 110, δ is expressed by Expression (1) as follows:

$$\delta = 503\sqrt{\frac{\rho_n}{f \cdot \mu_n}}. \quad (1)$$

The metal material used for the heat-generating layer 126 is any of, for example, gold, silver, copper, aluminum, zinc, tin, lead, bismuth, beryllium, and antimony, or an alloy of these metals. To decrease a warm-up time of the fixing device 100, the thickness of the heat-generating layer 126 is desirably small. Also, a non-magnetic metal material (paramagnetic material with a relative permeability of about 1) with a thickness in a range from 2 to 20 μm, and a specific resistance of $2.7\times10^{-8}$ Ω·cm or smaller is desirably used for the heat-generating layer 126 within a range of an alternating frequency from 20 to 100 kHz so that a general power supply is used. In this exemplary embodiment, copper with a thickness of 10 μm is used for the heat-generating layer 126 because the material provides a required heat amount efficiently and decreases the cost.

The elastic layer 128 uses silicon rubber or fluorocarbon rubber because the material is elastic and heat-resistant. In this exemplary embodiment, silicon rubber is used. In this exemplary embodiment, the elastic layer 128 has a thickness of 200 μm. The thickness of the elastic layer 128 may be determined in a range from 200 to 600 μm.

The release layer 130 decreases a bonding force between the toner image T on the sheet P (see FIG. 2) and the fixing belt 102, and causes the sheet P to be easily separated from the fixing belt 102. The release layer 130 may use fluorocarbon resin, silicon resin, or polyimide resin. In this exemplary embodiment, tetrafluoroethylene perfluoroalkoxy vinyl ether copolymer (PFA) is used. In this exemplary embodiment, the release layer 130 has a thickness of 30 μm.

Referring back to FIG. 2, the fixing device 100 is further described.

As shown in FIG. 2, the temperature-sensitive magnetic member 114 is provided inside the fixing belt 102. The temperature-sensitive magnetic member 114 which is an example of a heating member has an arc shape extending along the inner peripheral surface of the fixing belt 102, and is arranged to face the inner peripheral surface of the fixing belt 102. The temperature-sensitive magnetic member 114 is arranged to face the exciting coil 110 with the fixing belt 102 interposed therebetween. The temperature-sensitive magnetic member 114 is movable toward and away from the inner peripheral surface of the fixing belt 102. In particular, the temperature-sensitive magnetic member 114 is movable in the vertical direction in FIG. 2.

Figure 6A:
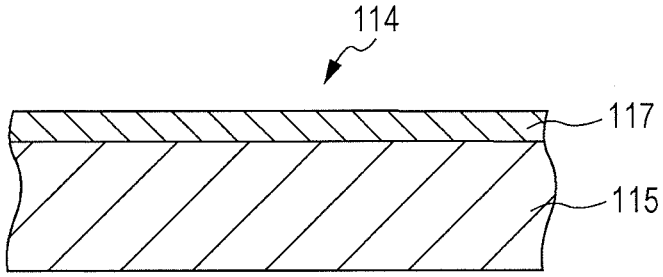
FIGS. 6A and 6B are illustrations for explaining a temperature-sensitive magnetic member.
Figure 6B:
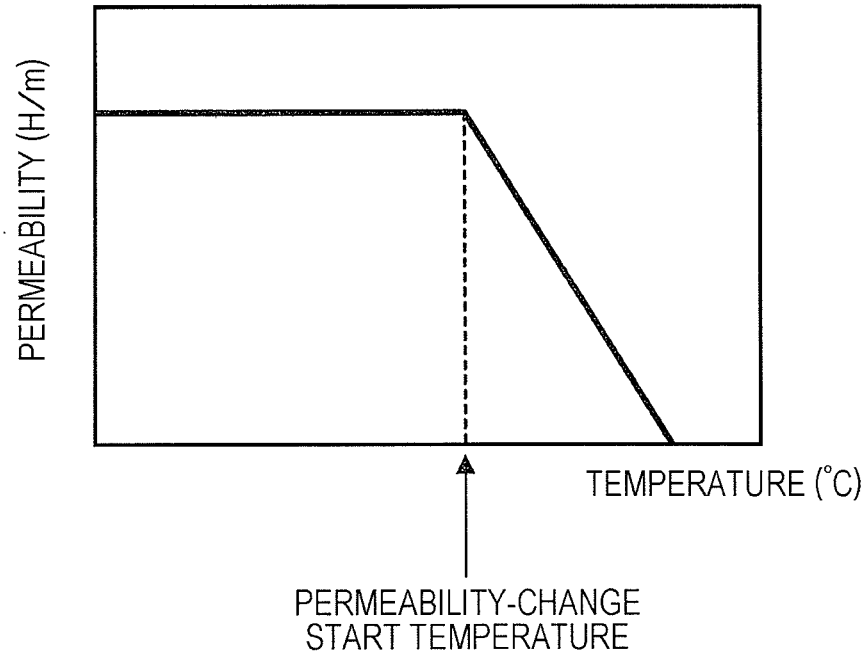

FIGS. 6A and 6B are illustrations for explaining the temperature-sensitive magnetic member 114.

As shown in FIG. 6A, the temperature-sensitive magnetic member 114 includes a temperature-sensitive layer 115 having a temperature-sensitive characteristic (described later) and serving as a base layer; and a heat-generating layer 117 stacked on a surface of the temperature-sensitive layer 115. In this exemplary embodiment, the heat-generating layer 117 is provided. However, if the temperature-sensitive layer 115 is enough to obtain a required heat amount, the heat-generating layer 117 may be omitted.

The temperature-sensitive layer 115 has a temperature-sensitive characteristic such that its permeability starts continuously decreasing at a permeability-change start temperature in a temperature region (temperature range) from a temperature equal to or higher than a fixing set temperature of the fixing belt 102 to a temperature equal to or lower than an upper temperature limit of the fixing belt 102. The temperature-sensitive layer 115 uses, for example, binary magnetic shunt steel such as a Fe—Ni alloy (permalloy), or ternary magnetic shunt steel such as a Fe—Ni—Cr alloy, having a permeability-change start temperature set within a range from 140° C. to 240° C. For example, in the case of Fe—Ni binary magnetic shunt steel, the permeability-change start temperature is set around 225° C. if Fe is about 64% and Ni is about 36% (atomic ratio). Alternatively, a metal alloy made of any of Fe, Ni, Si, B, Nb, Cu, Zr, Co, Cr, V, Mn, Mo, etc., may be used for the material. In this exemplary embodiment, a Fe—Ni alloy with a thickness of 150 μm is used. The heat-generating layer 117 may use a material with a characteristic similar to that of the heat-generating layer 126 of the fixing belt 102. In this exemplary embodiment, the heat-generating layer 117 uses copper with a thickness of 20 μm.

If the heat amount of the temperature-sensitive magnetic member 114 is too large, a portion that divides a path of eddy current flowing through the temperature-sensitive magnetic member 114 may be provided to restrict heat generation by the temperature-sensitive magnetic member 114. Specifically, the heat generation by the temperature-sensitive magnetic member 114 may be restricted by forming plural slits therein to cause the eddy current to hardly flow therethrough. The heat amount is adjustable by changing the number, width, length, and positions of the slits. Also, the slits are more effective if the slits are made in a direction substantially perpendicular to the path in which the eddy current flows.

Also, a non-magnetic metal layer with a low specific resistance may be provided on a surface of the temperature-sensitive magnetic member 114 opposite to a surface provided with the exciting coil 110. The non-magnetic metal layer has a function that equalizes a temperature distribution in the longitudinal direction (axial direction) of the temperature-sensitive magnetic member 114. In this case, a local increase in temperature is restricted. In a case in which the temperature of the temperature-sensitive layer 115 increases and the permeability continuously decreases at the permeability-change start temperature or higher, as long as many magnetic fluxes act on the non-magnetic metal layer, the heat amounts of the heat-generating layer 117 and temperature-sensitive layer 115 is restricted. This effect is similar to an effect provided by an inductive member 118 (described later). The material of the non-magnetic metal layer may be, for example, silver, copper, or aluminum.

As shown in FIG. 6B, the permeability-change start temperature is a temperature at which the permeability (measured on the basis of JIS C2531) starts continuously decreasing, and at which a penetrating amount of a magnetic flux of a magnetic field starts changing. The permeability-change start temperature is different from a Curie point, and is desirably set in a range from 150° C. to 230° C.

Referring back to FIG. 2, the fixing device 100 is further described.

As shown in FIG. 2, the inductive member 118 is provided inside the temperature-sensitive magnetic member 114. The inductive member 118 has a thickness equal to or larger than a skin depth. The inductive member 118 is desirably a non-magnetic metal with a low specific resistance. For example, the inductive member 118 may use silver, copper, or aluminum. By selecting any of these materials and the thickness is equal to or larger than the skin depth, if a magnetic field acts on the inductive member 118, eddy current more easily flows through the inductive member 118 rather than the heat-generating layer 117. The inductive member 118 includes an arc portion 118A that faces the inner peripheral surface of the temperature-sensitive magnetic member 114, and a column portion 118B that is integrally formed with the arc portion 118A.

The arc portion 118A of the inductive member 118 is arranged at a position at which, when the magnetic flux of the magnetic field H penetrates through the temperature-sensitive magnetic member 114, the arc portion 118A induces the magnetic flux of the magnetic field H. The inductive member 118 and the temperature-sensitive magnetic member 114 are separated from each other. In this exemplary embodiment, a pressing pad 132 is fixed at a lower end surface of the column portion 118B of the inductive member 118. The pressing pad 132 presses the fixing belt 102 outward. The pressing pad 132 is formed of an elastic member, such as urethane rubber or a sponge. An end surface of the pressing pad 132 is in contact with the inner peripheral surface of the fixing belt 102.

Also, in this exemplary embodiment, the pressure roller 104 is pressed to the outer peripheral surface of the fixing belt 102. The pressure roller 104 rotates in a direction indicated by arrow B in the drawing by rotation of the fixing belt 102. The pressure roller 104 has an elastic layer around a core bar 106 made of, for example, aluminum. The elastic layer is made of a silicon rubber foam sponge and has a thickness of 5 mm. Also, a release layer is formed around the elastic layer. The release layer is made of PFA containing carbon and has a thickness of 50 μm. Further, in this exemplary embodiment, a retract mechanism is provided in which a cam swings a bracket that rotatably supports the pressure roller 104. Accordingly, the outer peripheral surface of the fixing belt 102 and the outer peripheral surface of the pressure roller 104 come into contact each other and are separated from each other.

Also, in this exemplary embodiment, as shown in FIG. 2, a thermistor 134 is provided. The thermistor 134 is in contact with the inner peripheral surface of the fixing belt 102 and measures the surface temperature of the fixing belt 102. The thermistor 134 is provided in a region at an output side of a sheet P, the thermistor 134 not facing the exciting coil 110 in the region. The thermistor 134 measures the surface temperature of the fixing belt 102 by converting a resistance value that is changed in accordance with a heat amount of the heat given by the fixing belt 102 into a temperature. The thermistor 134 is provided to be in contact with a center portion in the longitudinal direction (width direction) of the fixing belt 102 so that the measurement value does not vary depending on the size of a sheet P.

As shown in FIG. 5B, the thermistor 134 is connected with a control circuit 138 that is provided in the control unit 50 (see FIG. 1) through a wire 136. The control circuit 138 is connected with an energizing circuit 142 through a wire 140. The energizing circuit 142 is connected with the exciting coil 110 through wires 144 and 146. The energizing circuit 142 is driven or stopped in response to an electric signal sent from the control circuit 138. The energizing circuit 142 supplies alternating current with a predetermined frequency to the exciting coil 110 through the wires 144 and 146 or interrupts the supply.

The control circuit 138 measures the surface temperature of the fixing belt 102 by performing temperature conversion based on a quantity of electricity sent from the thermistor 134. Then, the measurement temperature is compared with a previously stored fixing set temperature (for example, 170° C.). If the measurement temperature is lower than the fixing set temperature, the energizing circuit 142 is driven, electricity is applied to the exciting coil 110, and hence the magnetic field H (see FIG. 2) is generated. In contrast, if the measurement temperature is higher than the fixing set temperature, the energizing circuit 142 is stopped.

As shown in FIG. 2, the fixing device 100 in this exemplary embodiment includes a guide member 148 located downstream of a contact part (nip part) between the fixing belt 102 and the pressure roller 104 in the transport direction of the sheet P. The guide member 148 includes a support portion 148A with a first end thereof fixed, and a separate sheet 148B supported by the support portion 148A. The guide member 148 contacts a leading edge of a sheet P, which has been separated from the fixing belt 102, and guides the sheet P to the downstream side.

Figure 7:
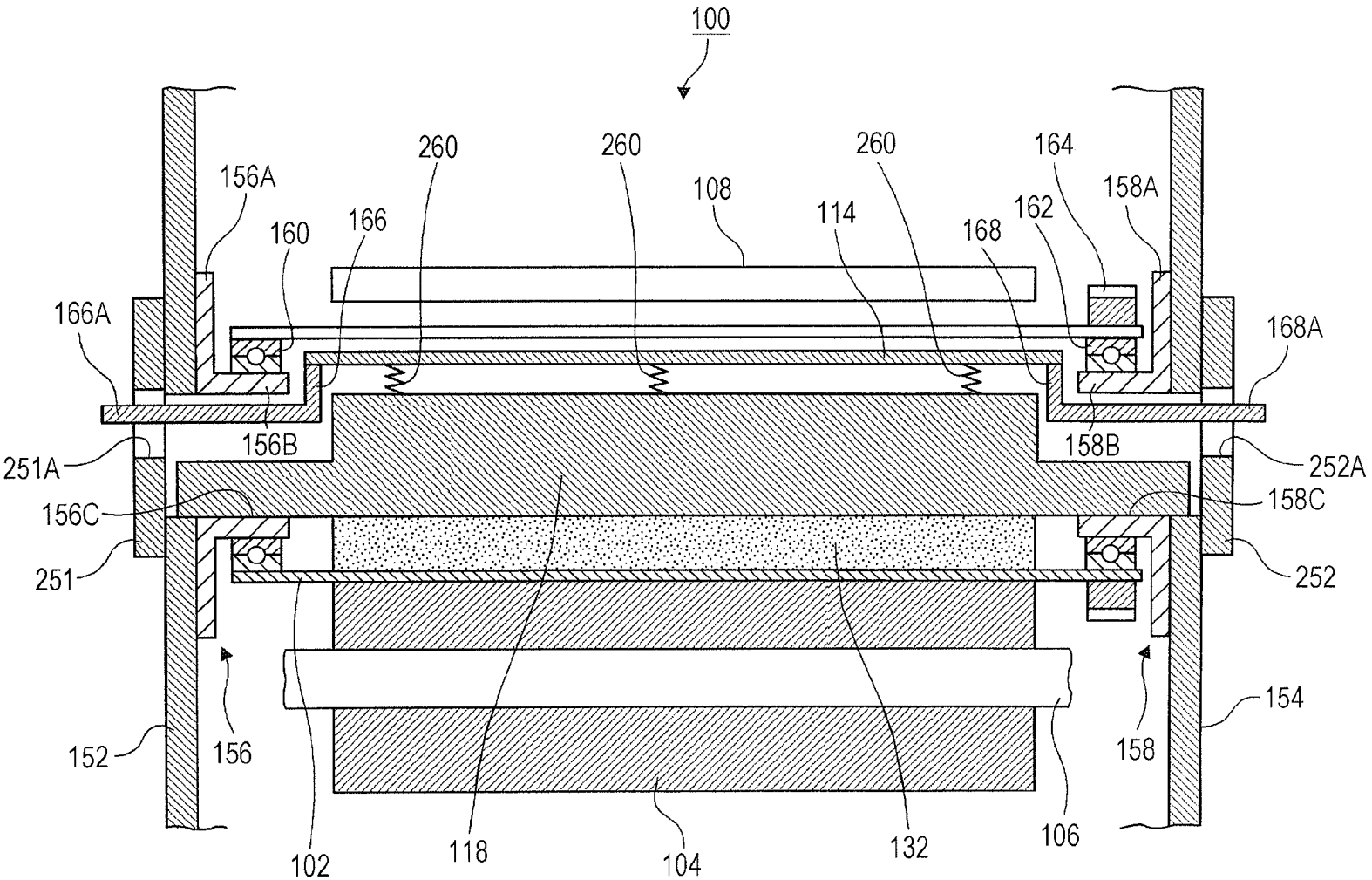
FIG. 7 is a cross-sectional view of the fixing device when the fixing device is viewed from the upstream side in a sheet transport direction.

FIG. 7 is a cross-sectional view of the fixing device 100 when the fixing device 100 is viewed from the upstream side in the transport direction of the sheet P.

The fixing device 100 is further described with reference to FIG. 7. As shown in the drawing, a first side plate 152 is provided at a first end portion of the fixing device 100, and a second side plate 154 is provided at a second end portion. A first support member 156 is fixed to an inner wall surface of the first side plate 152. A second support member 158 is fixed to an inner wall surface of the second side plate 154. The first support member 156 has a flat plate portion 156A fixed to the first side plate 152, a cylindrical protruding portion 156B protruding from the flat plate portion 156A, and a through hole 156C penetrating through the flat plate portion 156A and the protruding portion 156B. Similarly, the second support member 158 has a flat plate portion 158A fixed to the second side plate 154, a protruding portion 158B protruding from the flat plate portion 158A, and a through hole 158C penetrating through the flat plate portion 158A and the protruding portion 158B.

In this exemplary embodiment, a bearing 160 is attached on the outer peripheral surface of the protruding portion 156B, and a bearing 162 is attached on the outer peripheral surface of the protruding portion 158B. In this exemplary embodiment, the inner peripheral surface of the fixing belt 102 is fixed to the outer peripheral surfaces of the bearings 160 and 162. Accordingly, the fixing belt 102 is rotatable. Further, in this exemplary embodiment, a rotation-driving gear 164 is attached on a portion of the outer peripheral surface of the fixing belt 102, the portion which is located near the second side plate 154. In this exemplary embodiment, when the gear 164 receives a driving force from a motor (not shown), the fixing belt 102 rotates.

The temperature-sensitive magnetic member 114 is provided to extend in the longitudinal direction (width direction) of the fixing belt 102 as shown in FIG. 7. Also, in this exemplary embodiment, support members 166 and 168 are attached at both end portions of the temperature-sensitive magnetic member 114. The support members 166 and 168 have L-shaped cross sections. The support members 166 and 168 are formed of a member with a low thermal conductivity.

Hence, the heat of the temperature-sensitive magnetic member 114 is hardly transmitted to the support members 166 and 168.

The support member 166 is provided in a state in which the support member 166 passes through the through hole 156C and part of the support member 166 protrudes outside the first side plate 152. The support member 168 is provided in a state in which the support member 168 passes through the through hole 158C and part of the support member 168 protrudes outside the second side plate 154. In this exemplary embodiment, a first end portion of the inductive member 118 in the longitudinal direction is inserted into the through hole 156C and is fixed to the first support member 156. A second end portion of the inductive member 118 in the longitudinal direction is inserted into the through hole 158C and is fixed to the second support member 158.

In this exemplary embodiment, a deformable member 260 is provided between the temperature-sensitive magnetic member 114 and the inductive member 118 (also see FIG. 2). The deformable member 260 is deformed when receiving heat from the temperature-sensitive magnetic member 114. Plural deformable members 260 are provided. The deformable members 260 are arranged at positions shifted from each other in the longitudinal direction (width direction) of the fixing belt 102.

In this exemplary embodiment, a first guide member 251 and a second guide member 252 that are moved by expansion/contraction of the deformable members 260 (the detail will be described later) and guide the temperature-sensitive magnetic member 114. The first guide member 251 has a long hole 251A through which the support member 166 protruding from the first side plate 152 passes. The first guide member 251 contacts the support member 166 inserted through the long hole 251A to guide the temperature-sensitive magnetic member 114. The second guide member 252 has a long hole 252A through which the support member 168 protruding from the second side plate 154 passes. The second guide member 252 contacts the support member 168 inserted through the long hole 252A to guide the temperature-sensitive magnetic member 114.

The deformable members 260 have coil-spring-like shapes. The deformable members 260 are formed of a shape memory alloy. A shape memory alloy is metal (alloy) that has a shape memory effect that, even if large deformation is applied to the metal, the deformation which is non-recoverable for a typical metal material, the shape of the metal is recovered to an original shape only by heating the metal at a transformation temperature or higher. A currently practically used shape memory metal is typically a titanium-nickel alloy. There are ten or more types of shape memory alloys with shape memory effects, such as a copper-zinc-nickel alloy or a nickel-aluminum alloy.

The transformation temperature of a shape memory alloy may be adjusted in, for example, a range from −20° C. to 100° C. by adjusting a titanium-nickel mixing ratio or by adding cobalt or copper by a very small amount. The deformable member 260 in this exemplary embodiment is treated with two-way shape memory processing. The deformable member 260 expands when the deformable member 260 receives heat from the temperature-sensitive magnetic member 114 and hence the temperature thereof becomes a predetermined temperature (transformation temperature, in this exemplary embodiment, 100° C.), and the deformable member 260 contracts when the temperature of the deformable member 260 becomes lower than the predetermined temperature.

Next, a series of operations of fixing processing performed by the fixing device 100 will be described with reference to FIGS. 2 to 4.

When the fixing device 100 performs the fixing processing, the control unit 50 drives the driving motor (not shown), and hence the fixing belt 102 rotates in the direction indicated by arrow A in FIG. 2. At this time, the deformable member 260 is contracting, and the temperature-sensitive magnetic member 114 is separated from the fixing belt 102. Then, the energizing circuit 142 is driven in response to an electric signal from the control circuit 138, and alternating current is supplied to the exciting coil 110. Hence, generation of magnetic fields H that intersect with the heat-generating layer 126 (see FIG. 5A) of the fixing belt 102 and vanishment of the magnetic fields H are repeated.

When the magnetic fields H pass through the heat-generating layer 126 of the fixing belt 102, eddy current is generated at the heat-generating layer 126 so as to generate magnetic fields that disturb a change in magnetic fields H. Accordingly, the fixing belt 102 is heated. When the fixing belt 102 is heated in this way, the temperature-sensitive magnetic member 114 is separated from the fixing belt 102. Accordingly, the heat of the fixing belt 102 is hardly removed by the temperature-sensitive magnetic member 114, and the temperature of the fixing belt 102 rapidly increases. Also in this exemplary embodiment, when the fixing belt 102 is heated, the magnetic fields H enter the temperature-sensitive magnetic member 114, and hence the temperature-sensitive magnetic member 114 is also heated.

The thermistor 134 detects the temperature at the surface of the fixing belt 102. If the temperature does not reach the fixing set temperature (for example, 170° C.), the control circuit 138 controls driving of the energizing circuit 142 to supply alternating current with a predetermined frequency to the exciting coil 110. In contrast, if the temperature reaches the fixing set temperature, the control circuit 138 outputs a control signal to the energizing circuit 142 and stops the supply of the alternating current. In this exemplary embodiment, when the temperature of the fixing belt 102 reaches the fixing set temperature, the control unit 50 operates the retract mechanism (not shown) to cause the pressure roller 104 to contact the fixing belt 102. Hence, the pressure roller 104 rotates together with the rotating fixing belt 102.

Then, a sheet P is fed to the fixing device 100, and the fed sheet P is heated and pressed by the fixing belt 102 at the predetermined fixing set temperature (170° C.) and the pressure roller 104. Accordingly, a toner image is fixed to the sheet P. Then, the sheet P is output to the sheet output portion 38 by the sheet transport rollers 36.

In this exemplary embodiment, when the fixing processing is performed for a first sheet P, the heat of the sheet P is removed by the fixing belt 102. Also, when second and later sheets P are successively supplied, the heat of the fixing belt 102 is further removed. Accordingly, in this exemplary embodiment, as the fixing processing is performed for the sheets P, the temperature of the fixing belt 102 gradually decreases. Meanwhile, in this exemplary embodiment, the temperature-sensitive magnetic member 114 is heated in a state in which the temperature-sensitive magnetic member 114 is separated from the fixing belt 102. Thus, in the fixing device 100 of this exemplary embodiment, the temperature of the fixing belt 102 decreases while the temperature of the temperature-sensitive magnetic member 114 increases.

In this exemplary embodiment, as the temperature of the temperature-sensitive magnetic member 114 increases, the temperature of the deformable members 260 increases. When the temperature of the deformable members 260 becomes, for example, 100° C. (when the temperature of the deformable members 260 exceeds the transformation temperature), the deformable members 260 start expanding toward the inner peripheral surface of the fixing belt 102. In this exemplary embodiment, when the temperature of the deformable members 260 becomes 100° C., the temperature of the temperature-sensitive magnetic member 114 is at about 185° C. When the deformable members 260 expand, the deformable members 260 move the temperature-sensitive magnetic member 114. As shown in FIG. 3, the temperature-sensitive magnetic member 114 contacts the inner peripheral surface of the fixing belt 102. Hence, the heat is supplied from the temperature-sensitive magnetic member 114 to the fixing belt 102, and the temperature of the fixing belt 102 is prevented from decreasing. The temperature-sensitive magnetic member 114 may be moved by a solenoid or the like; however, in this case, a sensor that detects the temperature of the temperature-sensitive magnetic member 114 has to be additionally provided, and the configuration may become complicated.

The deformable members 260 in this exemplary embodiment are provided inside the cylindrical or substantially cylindrical fixing belt 102. Alternatively, for example, deformable members 260 may be provided inside the long hole 251A formed in the first guide member 251 (see FIG. 7), or inside the long hole 252A formed in the second guide member 252. In particular, a deformable member 260 may be provided in a region outside the fixing belt 102. The temperature at the outside of the fixing belt 102 varies depending on the environment in which the printer 10 is installed. If the deformable member 260 is provided in the region outside the fixing belt 102, a timing at which the deformable member 260 is transformed may likely vary. Owing to this, in this exemplary embodiment, the deformable member 260 is provided inside the fixing belt 102.

Figure 8:
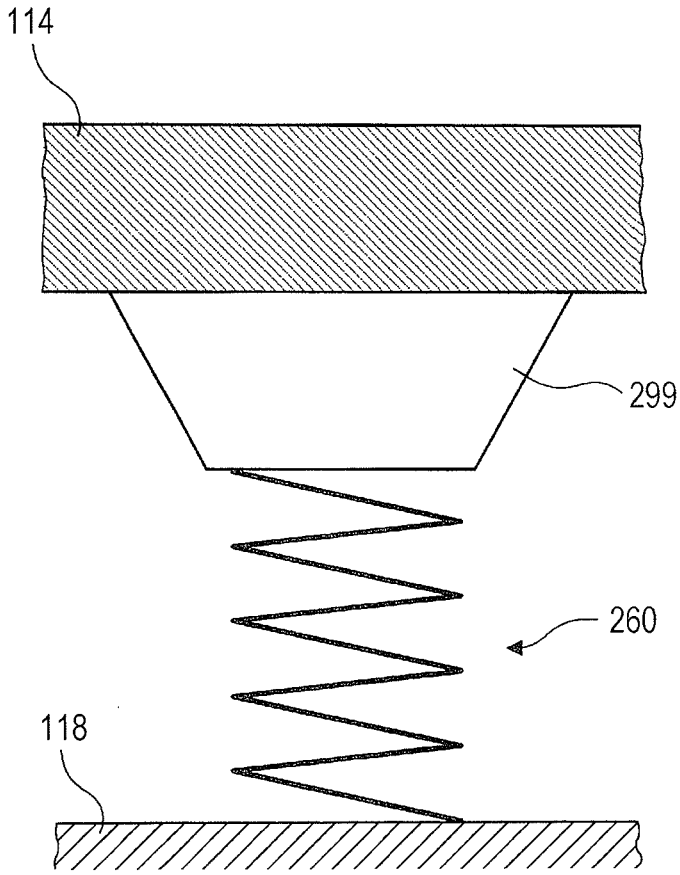
FIG. 8 is an illustration for explaining a structure around a deformable member.

In FIG. 7, the temperature-sensitive magnetic member 114 and the deformable members 260 directly contact each other. However, as show in FIG. 8 (an illustration for explaining a peripheral structure of the deformable member 260), a transmitting member 299 that transmits the heat from the temperature-sensitive magnetic member 114 to the deformable member 260 may be provided between the temperature-sensitive magnetic member 114 and the deformable member 260. The transmitting member 299 has a columnar shape and has an outer diameter that gradually decreases from the temperature-sensitive magnetic member 114 toward the deformable member 260.

Next, a function of the temperature-sensitive magnetic member 114 after the temperature-sensitive magnetic member 114 contacts the fixing belt 102 will be described also with reference to FIGS. 9A and 9B.

Figure 9B:
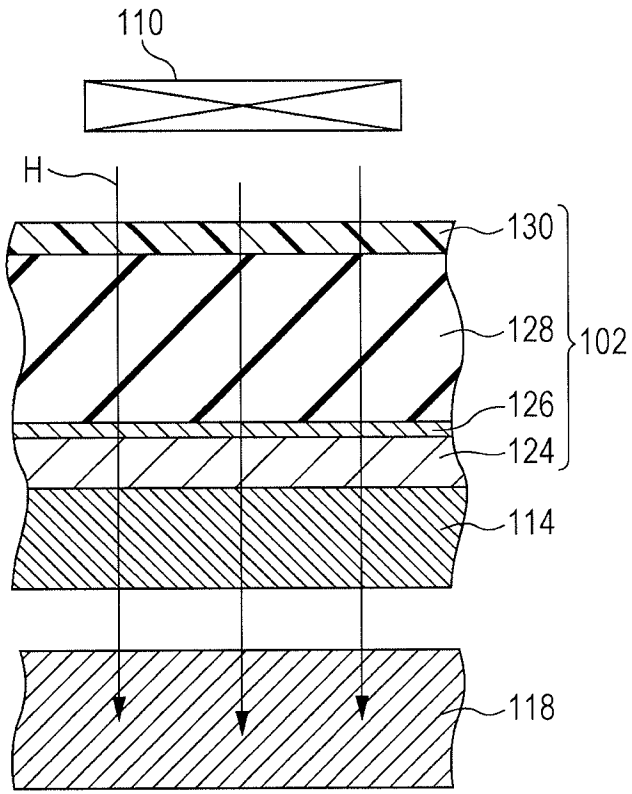
FIG. 9B is an illustration showing a state in which the temperature of the temperature-sensitive magnetic member is equal to or higher than the permeability-change start temperature.
Figure 9A:
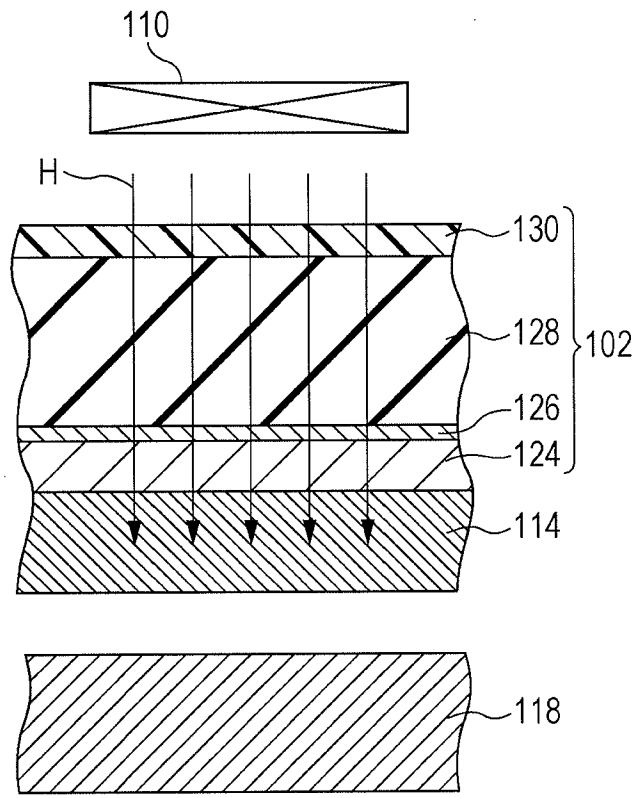
FIG. 9A is an illustration showing a state in which the temperature of the temperature-sensitive magnetic member is equal to or lower than a permeability-change start temperature.

FIG. 9A is an illustration showing a state in which the temperature of the temperature-sensitive magnetic member 114 is equal to or lower than a permeability-change start temperature. FIG. 9B is an illustration showing a state in which the temperature of the temperature-sensitive magnetic member 114 is equal to or higher than the permeability-change start temperature.

As shown in FIG. 9A, when the temperature of the temperature-sensitive magnetic member 114 is equal to or lower than the permeability-change start temperature (in a state shown in FIGS. 2 and 3), since the temperature-sensitive magnetic member 114 is a ferromagnetic substance, a magnetic flux density increases. Also, the magnetic fields H penetrating through the fixing belt 102 enter the temperature-sensitive magnetic member 114, closed magnetic circuit is formed, and the magnetic fields H are enhanced. Accordingly, the heat of the heat-generating layer 126 in the fixing belt 102 is obtained by a sufficient heat amount, and the temperature of the fixing belt 102 increases to the predetermined fixing set temperature.

In contrast, as shown in FIGS. 4 and 9B, when the temperature of the temperature-sensitive magnetic member 114 is equal to or higher than the permeability-change start temperature, the permeability of the temperature-sensitive magnetic member 114 decreases. The magnetic fields H penetrating through the fixing belt 102 penetrate through the temperature-sensitive magnetic member 114, and are headed to the inductive member 118. At this time, the magnetic flux density decreases and the magnetic fields H become weak. The closed magnetic circuit is no longer formed. Further, the eddy current flows in the inductive member 118 by a larger amount than the eddy current in the heat-generating layer 126 and the temperature-sensitive magnetic member 114. The heat amounts of the heat-generating layer 126 and the temperature-sensitive magnetic member 114 decrease. Hence, the temperatures of the fixing belt 102 and the temperature-sensitive magnetic member 114 decrease.

Figure 10:
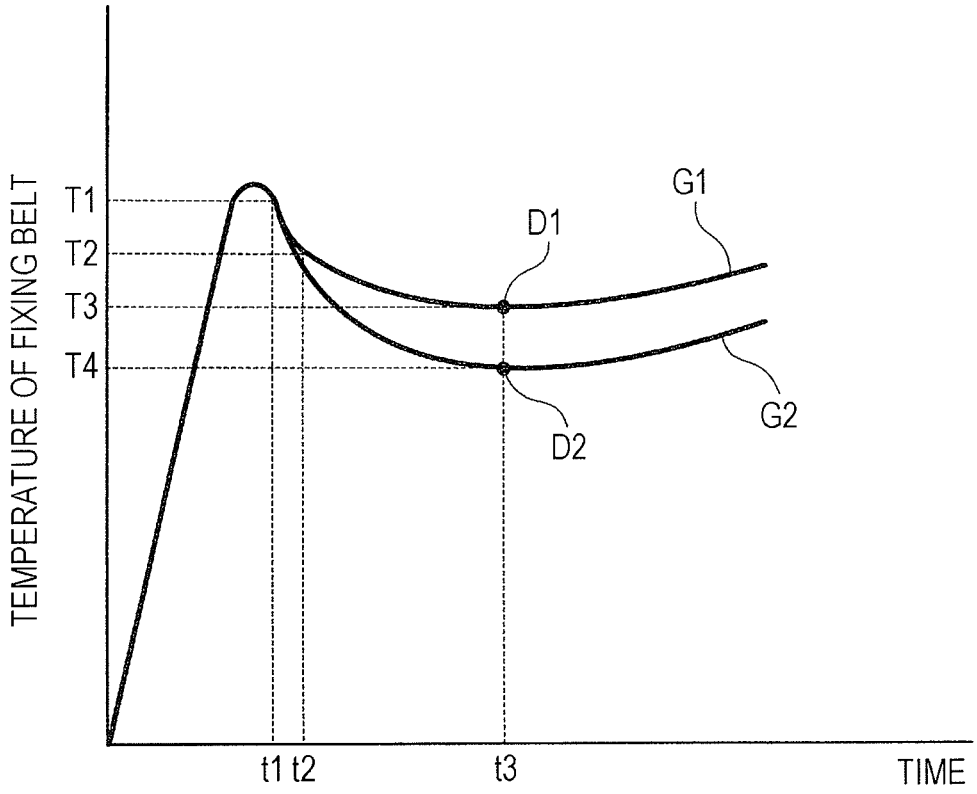
FIG. 10 is an illustration showing a change in temperature of a fixing belt when fixing processing is performed for plural sheets.

FIG. 10 is an illustration showing a change in temperature of the fixing belt 102 when the fixing processing is performed for plural sheets P.

A graph G1 in FIG. 10 is a time-temperature curve of the fixing device 100 according to this exemplary embodiment. A graph G2 is a time-temperature curve according to a comparative example. In particular, G2 is a time-temperature curve of the fixing device 100 in which the temperature-sensitive magnetic member 114 and the fixing belt 102 do not contact each other.

In the graph G1, the temperature of the fixing belt 102 increases until a time t1, and the pressure roller 104 contacts the fixing belt 102 in a state in which the temperature is slightly overshot from a target fixing set temperature T1. When the pressure roller 104 contacts the fixing belt 102, the pressure roller 104 removes the fixing belt 102. Hence the temperature of the fixing belt 102 decreases to the fixing set temperature T1. Then, fixing for a first sheet P is performed between the time t1 and a time t2. As the result, the first sheet P removes the heat of the fixing belt 102, and the temperature of the fixing belt 102 decreases to a temperature T2.

Then, a second sheet P is supplied between the time t2 and a time t3. The second sheet P removes the heat of the fixing belt 102. In this exemplary embodiment, almost when the second sheet P is supplied, the temperature-sensitive magnetic member 114, which is at a temperature higher than the temperature of the fixing belt 102, contacts the fixing belt 102. In particular, thermal conductivities of respective members are set such that the temperature of the deformable members 260 is at about 100° C. almost when the second sheet P is supplied. When the second sheet P is supplied, the deformable members 260 start expanding, and the temperature-sensitive magnetic member 114 contacts the fixing belt 102.

Accordingly, the heat is supplied from the temperature-sensitive magnetic member 114 to the fixing belt 102. As the result, in this exemplary embodiment, the degree of decrease in temperature of the fixing belt 102 is reduced. Here, when it is assumed that a lowermost point of the temperature of the fixing belt 102 is a temperature droop (D), in the fixing device 100 according to this exemplary embodiment, the temperature becomes a temperature droop D1 (temperature T3) at the time t3.

In contrast, in the fixing device 100 according to the comparative example, as described above, the temperature-sensitive magnetic member 114 and the fixing belt 102 do not contact each other. Hence, the heat is not supplied from the temperature-sensitive magnetic member 114 to the fixing belt 102, and the temperature decreases to a temperature droop D2 (temperature T4 (<temperature T3)).

Figure 11:
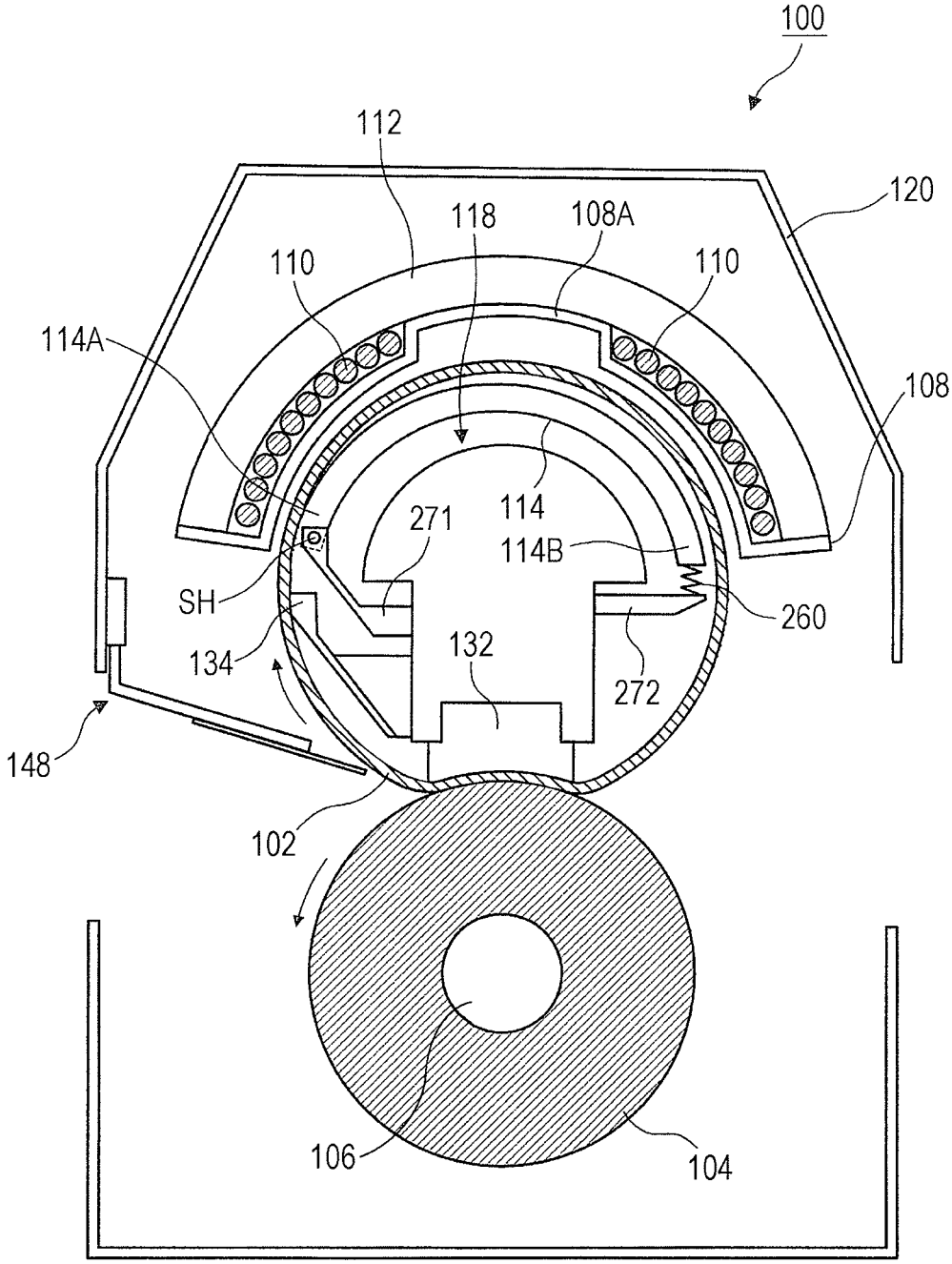
FIG. 11 is an illustration showing another exemplary embodiment of the fixing device.

FIG. 11 is an illustration showing another exemplary embodiment of the fixing device 100.

In a fixing device 100 shown in the drawing, a shaft SH penetrates through a first end portion 114A (first end portion located at the upstream side of the fixing belt 102 in the rotation direction) of the temperature-sensitive magnetic member 114. This temperature-sensitive magnetic member 114 is rotatable (swingable) around the first end portion 114A. The shaft SH is supported by a first support member 271 attached to a first side surface of an inductive member 118. Also in this exemplary embodiment, a second support member 272 is attached to a second side surface of the inductive member 118. The second support member 272 extends to a position below a second end portion 114B of the temperature-sensitive magnetic member 114. Also in this exemplary embodiment, a deformable member 260 is provided between the second end portion 114B of the temperature-sensitive magnetic member 114 and the second support member 272.

In this exemplary embodiment, when the deformable member 260 expands, the second end portion 114B of the temperature-sensitive magnetic member 114 moves upward in the drawing. Accordingly, the temperature-sensitive magnetic member 114 is entirely displaced upward in the drawing. By the displacement, the temperature-sensitive magnetic member 114 contacts the inner peripheral surface of a fixing belt 102. With the configuration shown in FIG. 2, the deformable members 260 are arranged between the temperature-sensitive magnetic member 114 and the inductive member 118. Thus, the distance between the temperature-sensitive magnetic member 114 and the inductive member 118 is large. In this case, the size of the fixing device 100 may be increased. With the configuration shown in FIG. 11, the distance between the temperature-sensitive magnetic member 114 and the inductive member 118 may be small, and hence the size of the fixing device 100 may be decreased.

Figure 12C:
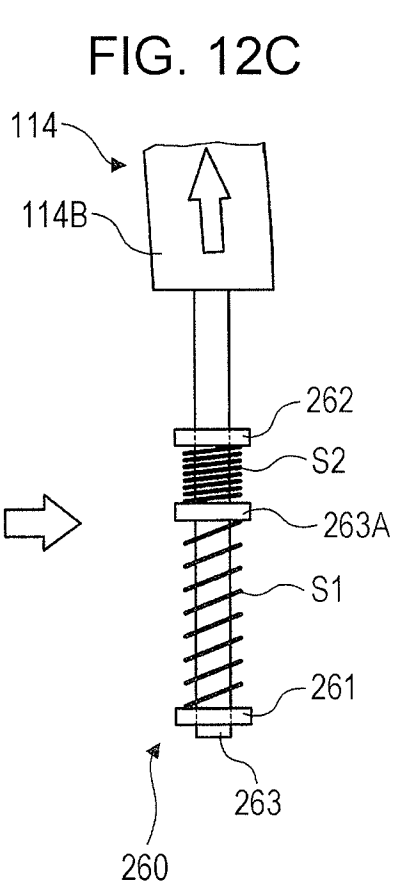
FIGS. 12A to 12C are illustrations showing another configuration example of the deformable member.
Figure 12B:
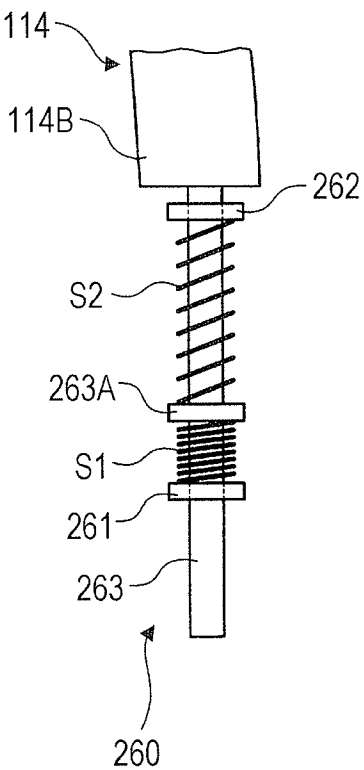
Figure 12A:
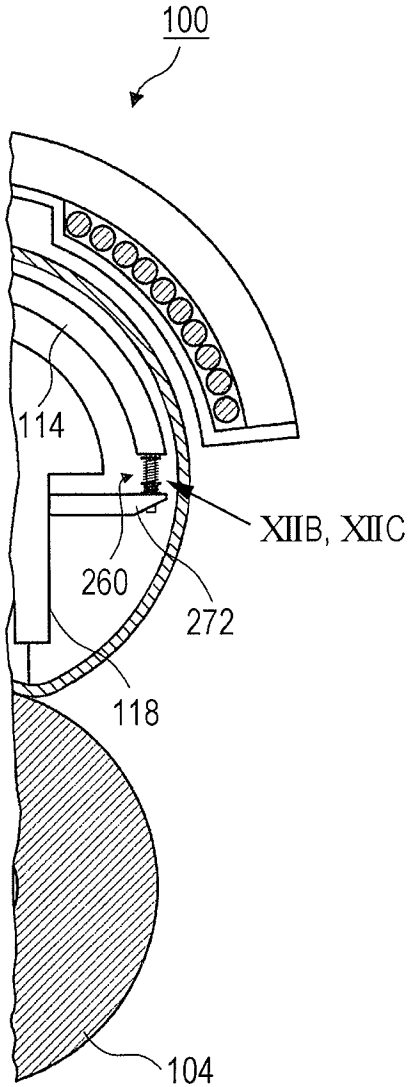

FIGS. 12A to 12C are illustrations showing another configuration example of the deformable member 260.

A deformable member 260 shown in FIGS. 12A to 12C is formed of plural components. In particular, as shown in FIG. 12B, the deformable member 260 is provided in contact with a second end portion 114B of a temperature-sensitive magnetic member 114, and includes a shaft-like advancing/retracting member 263 that is provided to advance and retract with respect to the second end portion 114B. A protrusion 263A is provided at a center portion of the advancing/retracting member 263 in the longitudinal direction. The protrusion 263A protrudes in the radial direction of the advancing/retracting member 263.

The deformable member 260 according to this exemplary embodiment is provided with a first support member 261 that supports the advancing/retracting member 263 in a state in which the advancing/retracting member 263 is able to advance and retract. A second support member 262 is provided at a position closer to the temperature-sensitive magnetic member 114 as compared with the first support member 261. The second support member 262 supports the advancing/retracting member 263. A first coil spring S1 is provided between the protrusion 263A and the first support member 261. A second coil spring S2 is provided between the protrusion 263A and the second support member 262. The first coil spring S1 is formed of a shape memory alloy. Similarly to the above-mentioned shape memory alloy, the shape memory alloy expands when the temperature thereof is at a predetermined temperature (for example, 100° C.), and the shape memory alloy contracts when the temperature thereof is lower than this temperature.

With the configuration shown in FIGS. 12A to 12C, heat is transmitted from the heated temperature-sensitive magnetic member 114 to the first coil spring S1, and when the temperature of the first coil spring S1 exceeds the predetermined temperature, the first coil spring S1 expands. When the first coil spring S1 expands, the protrusion 263A in FIG. 12B is pushed upward in the drawing by the first coil spring S1. Accordingly, as shown in FIG. 12C, the advancing/retracting member 263 is displaced upward in the drawing. By the displacement, the temperature-sensitive magnetic member 114 is pushed against the fixing belt 102.

The first coil spring S1 contracts when the temperature of the temperature-sensitive magnetic member 114 decreases. With the configuration according to this exemplary embodiment, since the second coil spring S2 that causes a compression force to act on the first coil spring S1 is provided, the first coil spring S1 contracts more rapidly. In a situation in which the first coil spring S1 hardly contracts (if the first coil spring S1 takes a time for contraction), the fixing belt 102 is easily heated in a state in which the temperature-sensitive magnetic member 114 contacts the fixing belt 102. In this case, the heat of the fixing belt 102 is released to the temperature-sensitive magnetic member 114, and heating efficiency of the fixing belt 102 may be degraded.

As shown in FIGS. 12A to 12C, when the second coil spring S2 is provided, the first coil spring S1 may be formed of a shape memory alloy that is treated with one-way shape memory processing, and hence expands when the temperature increases but does not contract when the temperature decreases. If the first coil spring S1 formed of the shape memory alloy treated with the one-way shape memory processing is merely arranged, the first coil spring S1 continuously expands but does not contract even if the temperature decreases, possibly resulting in that the temperature-sensitive magnetic member 114 is continuously in contact with the fixing belt 102. If the second coil spring S2 is provided, the first coil spring S1 is compressed by the second coil spring S2. Even if the first coil spring S1 formed of the shape memory alloy treated with the one-way shape memory processing is used, the temperature-sensitive magnetic member 114 is separated from the fixing belt 102.

Figure 13:
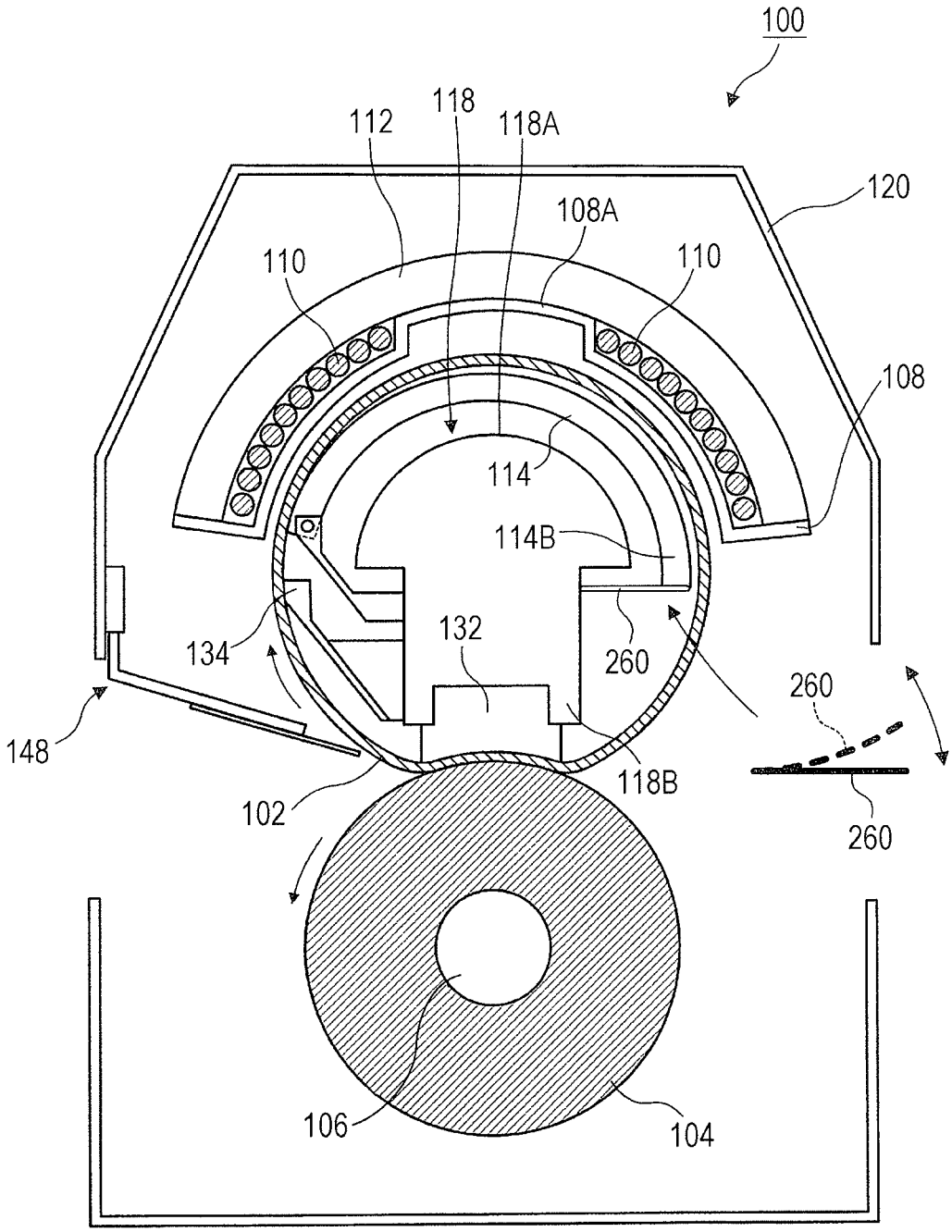
FIG. 13 is an illustration showing another configuration example of the deformable member.

FIG. 13 is an illustration showing another configuration example of the deformable member 260.

In the above description, the deformable member 260 has a coil-spring-like shape. The deformable member 260 may have a plate-like shape as shown in the drawing. A plate-like deformable member 260 is provided such that a first end thereof is fixed to a side surface of an inductive member 118, the deformable member 260 extends toward a second end portion 114B of a temperature-sensitive magnetic member 114, and a second end thereof is fixed to the second end portion 114B.

The deformable member 260 in FIG. 13 uses a shape memory alloy treated with two-way shape memory processing. When the temperature of the deformable member 260 exceeds a predetermined temperature (for example, 100° C.), the deformable member 260 is bent toward the temperature-sensitive magnetic member 114 as indicated by a dotted line in the drawing. In this exemplary embodiment, because the temperature-sensitive magnetic member 114 is bent (curved), an end portion of the deformable member 260 is displaced upward in the drawing. Because of the displaceable end portion, the temperature-sensitive magnetic member 114 moves upward in the drawing. Hence, the temperature-sensitive magnetic member 114 contacts the inner peripheral surface of the fixing belt 102.

When the temperature of the deformable member 260 decreases, the deformable member 260 is transformed from the bent state to the flat state. Accordingly, the temperature-sensitive magnetic member 114 is separated from the fixing belt 102. With the configuration in this exemplary embodiment, the deformable member 260 may be arranged along a direction (horizontal direction) intersecting with (perpendicular to) a direction (up-down direction) in which the temperature-sensitive magnetic member 114 is moved. The degree of freedom for arrangement of the deformable member 260 increases. In particular, an arrangement form other than the arrangement form in FIG. 2 etc. may be employed. Thus, the degree of freedom for arrangement of the deformable member 260 increases.

The fixing device 100 provided in the printer 10 has been described above. Alternatively, the above-described configuration may be applied to a heating device that heats a member to be heated.

Figure 14A:
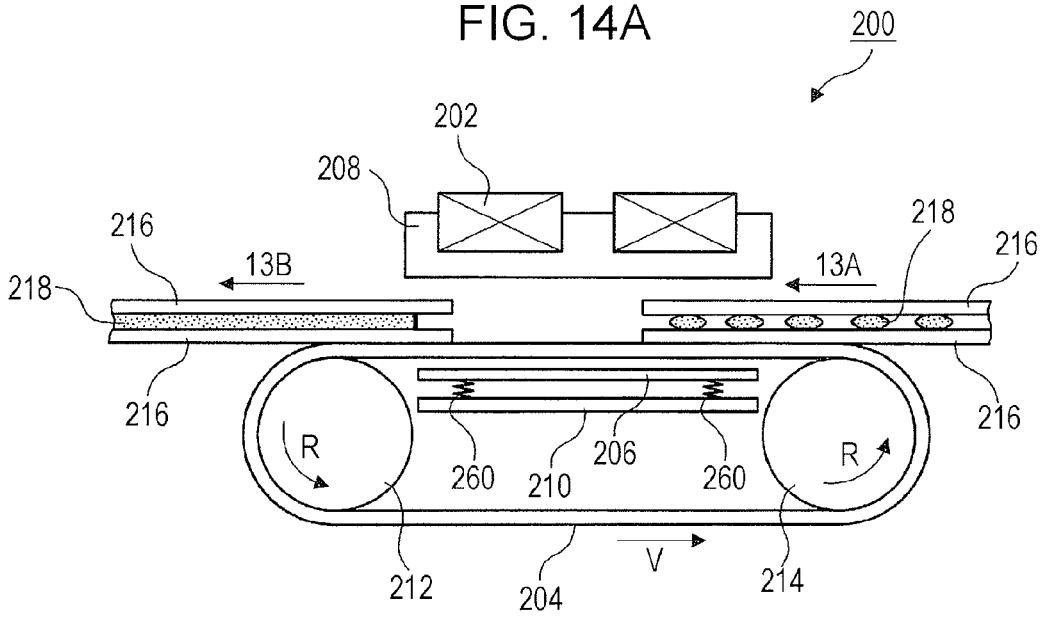
FIGS. 14A and 14B are illustrations for explaining a heating device.
Figure 14B:
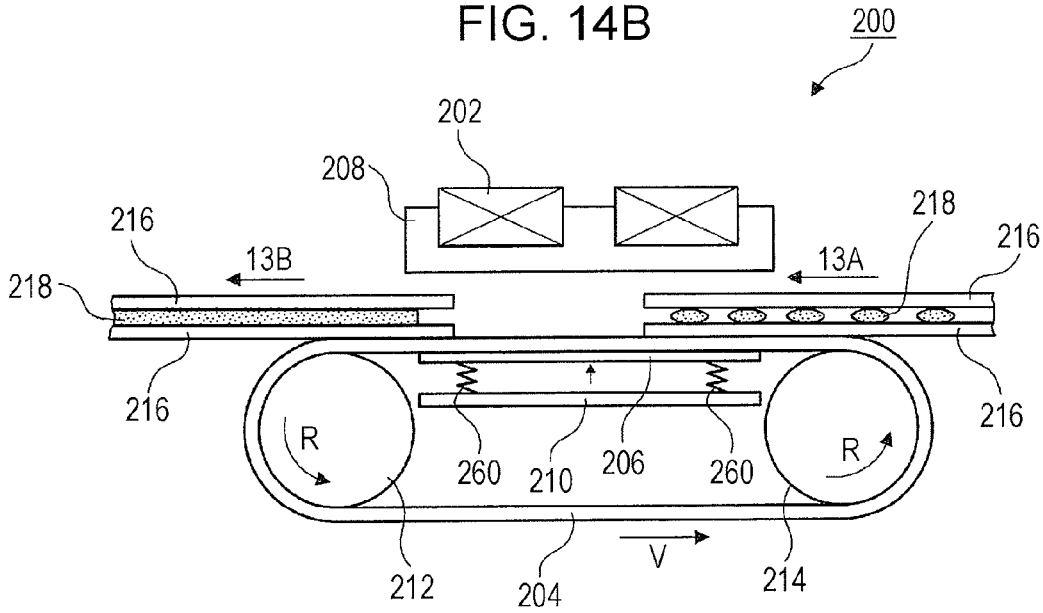

FIGS. 14A and 14B are illustrations for explaining a heating device. Like reference signs refer like members having functions equivalent to those of the above-described exemplary embodiment, and redundant description will be omitted.

As shown in FIG. 14A, a heating device 200 includes exciting coils 202 that generate magnetic fields, and a heating belt 204 that is arranged to face the exciting coils 202 and is formed of a material and a layer configuration similar to those of the above-described fixing belt 102. The heating device 200 includes a temperature-sensitive magnetic members 206 that is similar to the above-described temperature-sensitive magnetic member 114. The temperature-sensitive magnetic member 206 is arranged inside the heating belt 204, at a position separated from the heating belt 204. The heating device 200 further includes a temperature sensor (not shown) that is provided in contact with the inner peripheral surface of the heating belt 204 and detects the temperature of the heating belt 204.

The exciting coils 202 are supported by a bobbin 208 made of resin. Also, the heating belt 204 is supported by a pair of rotatable rollers 212 and 214. The rollers 212 and 214 each have a core bar formed of non-magnetic SUS, and an elastic layer around the core bar. One of the rollers 212 and 214 is connected with a driving mechanism, such as a gear and a motor. In this exemplary embodiment, the rollers 212 and 214 are rotated by the driving mechanism in a direction indicated by arrow R. Hence, the heating belt 204 moves in a direction indicated by arrow V.

The temperature-sensitive magnetic member 206 according to this exemplary embodiment has a flat-plate-like shape. An inductive member 210 is provided inside the temperature-sensitive magnetic member 206. The inductive member 210 has a flat-plate-like shape and is formed of the same material as that of the inductive member 118. The inductive member 210 may have a thickness equal to or larger than a skin depth. In this example, an aluminum member with a thickness of 1 mm is used for the inductive member 210. In the heating device 200, like the above-described configuration, deformable members 260 are provided between the temperature-sensitive magnetic member 206 and the inductive member 210. A control unit similar to the above-described control unit (see FIG. 1) performs operation control for respective units of the heating device 200.

An operation of the heating device 200 will be described. Described hereinafter is a case in which the heating device 200 is used for fusion bonding.

An energizing unit (not shown) energizes the exciting coils 202, and magnetic fields are generated around the exciting coils 202. The heating belt 204 generates heat by an electromagnetic induction effect due to the magnetic fields, like the above-described fixing belt 102. A heat-generating layer of the temperature-sensitive magnetic member 206 also generates heat by an electromagnetic induction effect due to the magnetic fields. The temperature-sensitive magnetic member 206 is arranged with a gap with respect to the heating belt 204. Hence, the heat of the heating belt 204 is hardly transmitted to the temperature-sensitive magnetic member 206. Accordingly, the temperature of the heating belt 204 increases in a short time.

Then, in the heating device 200, the rollers 212 and 214 rotate, and the heating belt 204 starts moving in the direction indicated by arrow V. A pair of resin plates 216 (an example of a member to be heated) is transported to the heating device 200 (see arrow 13A). A solid adhesive 218 is interposed between the pair of plates 216. The adhesive 218 melts at a predetermined temperature. Then, heat is supplied from the heating belt 204, which is an example of a supply member, to the plates 216 and the adhesive 218. The adhesive 218 melts and spreads between the pair of plates 216. Then, the plates 216 are output from the heating device 200 by the movement of the heating belt 204 (see arrow 13B). The pair of plates 216 output from the heating device 200 is bonded together because the melting and spreading adhesive 218 is cooled and hardened.

Similarly to the above-described situation, when the plates 216 are transported, the temperature of the heating belt 204 decreases. Meanwhile, the temperature-sensitive magnetic member 206 is heated, and the temperature of the deformable members 260 increases because of the heat generation by the temperature-sensitive magnetic member 206. When the temperature of the deformable members 260 becomes a predetermined temperature, as shown in FIG. 14B, the deformable members 260 expand and push up the temperature-sensitive magnetic member 206. Accordingly, the temperature-sensitive magnetic member 206 contacts the inner peripheral surface of the heating belt 204, and the heat is supplied from the temperature-sensitive magnetic member 206 to the heating belt 204. Hence, the temperature of the heating belt 204 is prevented from decreasing.

Figure 15:
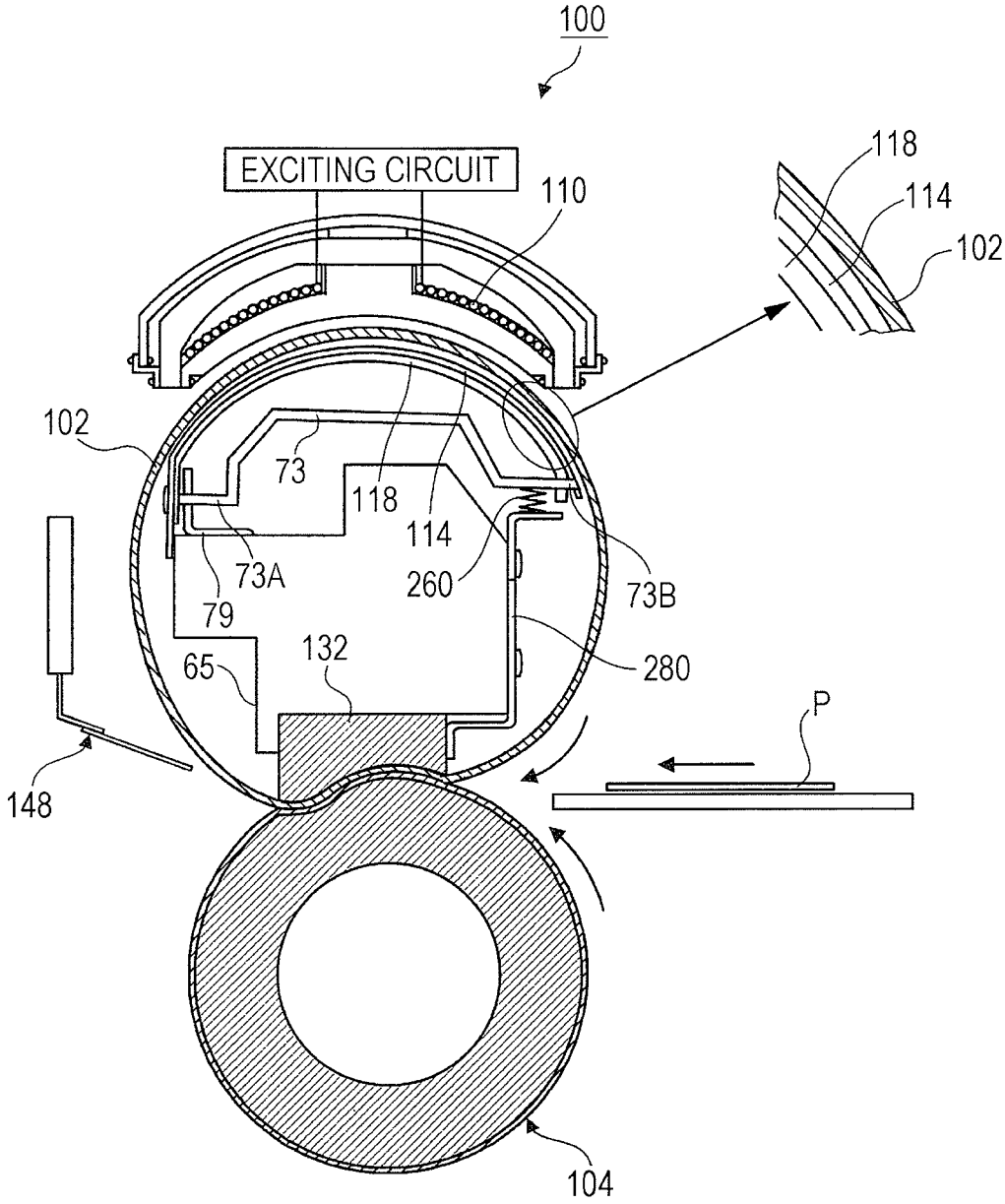
FIG. 15 is an illustration showing another exemplary embodiment of the fixing device.

The fixing device 100 may be formed as shown in FIG. 15.

FIG. 15 is an illustration showing another exemplary embodiment of the fixing device 100.

A fixing device 100 shown in FIG. 15 includes a frame 65 inside a fixing belt 102, and an inductive member 118 that is attached to the frame 65, has a plate-like shape, and has a curve extending along the inner peripheral surface of the fixing belt 102. With the configuration in the drawing, the inductive member 118 has a plate-like shape, and hence the fixing device 100 in the drawing has a smaller weight than the fixing device 100 shown in FIG. 2 and other drawings. The frame 65 is formed by combining plural metal sheets (not shown). The weight of the frame 65 is reduced as compared with a case in which a portion corresponding to the frame 65 is formed of a pure metal material.

The thickness of the inductive member 118 may be equal to or larger than a skin depth such that, even if the temperature-sensitive magnetic member 114 becomes non-magnetic and a magnetic flux penetrates through the inductive member 118, the magnetic flux hardly penetrates through the inductive member 118. In this exemplary embodiment, an aluminum member with a thickness of 1 mm is used. In this exemplary embodiment, like the above-described configuration, a temperature-sensitive magnetic member 114 is provided between the inductive member 118 and the fixing belt 102. Further, in this exemplary embodiment, a magnetic-path shielding member 73 is provided inside the inductive member 118. The magnetic-path shielding member 73 prevents magnetic force lines from leaking to the frame 65.

In this exemplary embodiment, a first end portion of the inductive member 118 and a first end portion of the temperature-sensitive magnetic member 114 are fixed to a first end 73A of the magnetic-path shielding member 73. Also, a second end portion of the inductive member 118 and a second end portion of the temperature-sensitive magnetic member 114 are fixed to a second end 73B of the magnetic-path shielding member 73. In this exemplary embodiment, a bent metal sheet 280 is fixed to a right side surface of the frame 65. Also, a deformable member 260 is provided between the metal sheet 280 and the second end 73B of the magnetic-path shielding member 73.

Further, in this exemplary embodiment, a support member 79 that supports the first end 73A of the magnetic-path shielding member 73 is provided. The magnetic-path shielding member 73 swings around the first end 73A. In the fixing device 100 shown in FIG. 15, the deformable member 260 expands by an increase in temperature of the temperature-sensitive magnetic member 114. With the expansion, the temperature-sensitive magnetic member 114 is pressed to the fixing belt 102. Thus, the heat is supplied from the temperature-sensitive magnetic member 114 to the fixing belt 102, the heat of which has been removed by a sheet P.

The case in which a solid developer is used has been described above as an example. Alternatively, a liquid developer may be used. The temperature of the fixing belt 102 may be detected by using a thermocouple instead of the thermistor 134. The thermistor 134 does not have to be provided at the inner periphery side of the fixing belt 102, and may be provided at the outer periphery side of the fixing belt 102. Further, the above-described temperature-sensitive magnetic member 114 may be formed of a material of only one type of temperature-sensitive layer through which eddy current easily flows. The above-described heating device 200 has been used for fusion bonding; however, the heating device 200 may be used as a drier.

In the above description, the deformable member 260 is formed of a shape memory metal. However, a member formed by bonding two metals with different thermal expansion coefficients together, i.e., so-called bimetal may be used as the deformable member 260. Before the deformable member 260 expands (before heating of the fixing belt 102 is completed), the fixing belt 102 is desirably separated from the temperature-sensitive magnetic member 114. However, as shown in FIG. 2 and other drawings, part of the temperature-sensitive magnetic member 114 may be in contact with the inner peripheral surface of the fixing belt 102. In FIG. 2, a first end portion located at the upstream side of the fixing belt 102 in the rotation direction and a second end portion located at the downstream side of the fixing belt 102 in the rotation direction are in contact with the inner peripheral surface of the fixing belt 102.

In FIG. 11 etc., the first end portion of the temperature-sensitive magnetic member 114 is displaced by using the deformable member 260. Alternatively, deformable members 260 may be provided to face the first end portion and the second end portion of the temperature-sensitive magnetic member 114, and both end portions of the temperature-sensitive magnetic member 114 may be displaced. Referring to FIG. 2, the temperature-sensitive magnetic member 114 contacts the inner peripheral surface of the fixing belt 102 by using the expansion of the deformable members 260. Alternatively, the temperature-sensitive magnetic member 114 may contact the fixing belt 102 when the deformable member 260 contracts.

In the above description, the temperature-sensitive magnetic member 114 is heated. Alternatively, a slit or the like may be formed in the temperature-sensitive magnetic member 114 so that the temperature-sensitive magnetic member 114 is not heated (or is hardly heated). In this case, energy used for heating the temperature-sensitive magnetic member 114 acts on the fixing belt 102. In particular, energy used for heating the temperature-sensitive magnetic member 114 is given to the fixing belt 102. Heating efficiency of the fixing belt 102 increases.

Figure 16:
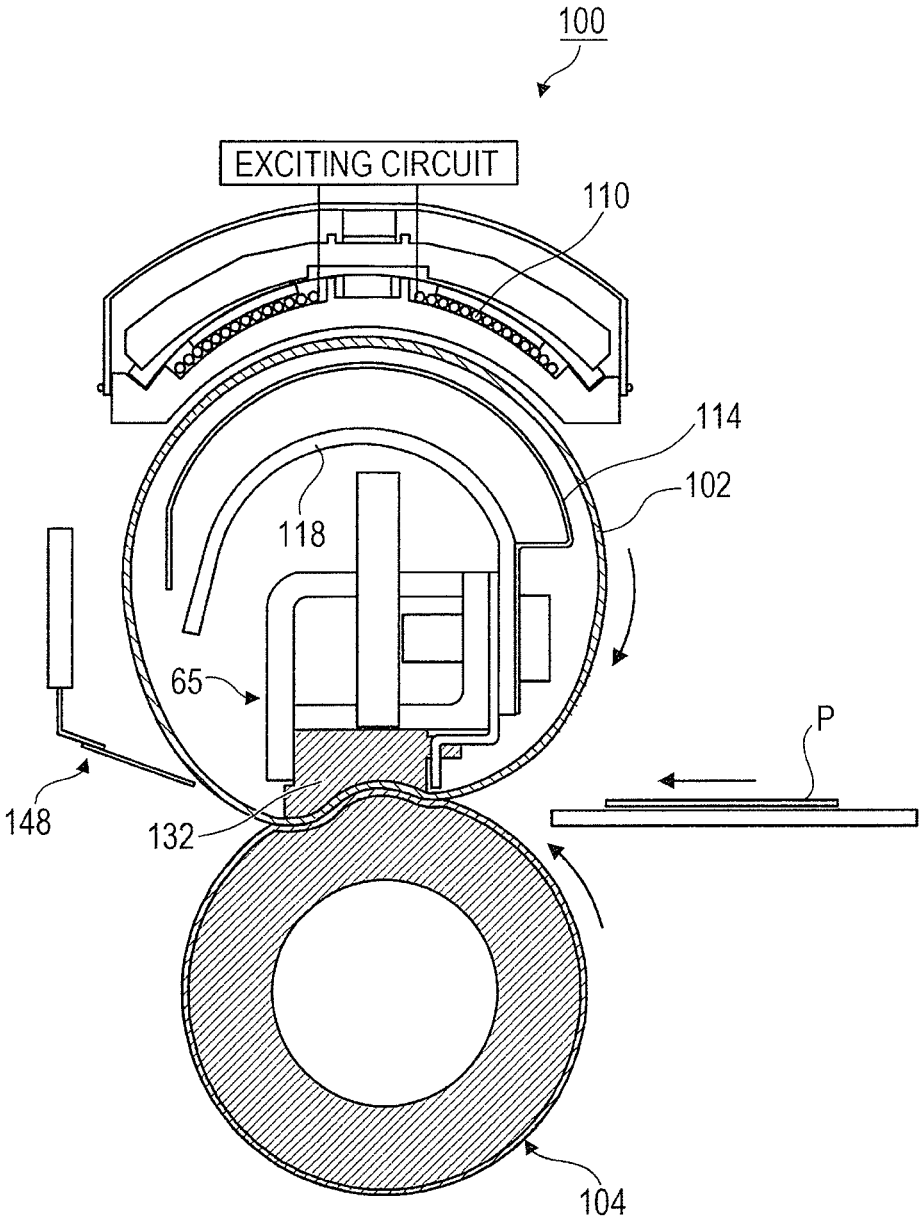
FIG. 16 is an illustration showing a fixing device in which a temperature-sensitive magnetic member is not heated.

FIG. 16 is an illustration showing a fixing device 100 in which a temperature-sensitive magnetic member 114 is not heated. In the fixing device 100, a slit (described later) is formed in the temperature-sensitive magnetic member 114 to prevent the temperature-sensitive magnetic member 114 from being heated. Also, to prevent the heat of the fixing belt 102 from being removed by the temperature-sensitive magnetic member 114, the temperature-sensitive magnetic member 114 is separated from the fixing belt 102. In the fixing device 100 shown in FIG. 16, an inductive member 118 has a plate-like shape and is curved like the fixing device 100 shown in FIG. 15. Also, in the fixing device 100 shown in FIG. 16, a frame 65 is formed by combining plural metal sheets.

If the temperature-sensitive magnetic member 114 is not heated, as described above, the energy used for heating the temperature-sensitive magnetic member 114 acts on the fixing belt 102, and hence the temperature of the fixing belt 102 more rapidly increases. In this case, a time until fixing processing is able to be started becomes shorter. To be more specific, in the fixing device 100 shown in FIG. 16, as shown in FIG. 17 (an illustration for explaining a heat-generation ratio between the fixing belt 102 and the temperature-sensitive magnetic member 114 etc.), a heat-generation ratio between the fixing belt 102 and the temperature-sensitive magnetic member 114 may be about 10:0. In this case, fixing processing may be performed by, for example, three seconds.

With this configuration, when plural sheets P are continuously transported, the heat of the fixing belt 102 is gradually removed, and the temperature of the fixing belt 102 decreases. If the temperature of the fixing belt 102 becomes a certain temperature or lower, fixing becomes difficult. The fixing processing is temporarily interrupted, and fixing has to wait until the temperature of the fixing belt 102 is recovered. As the result, with a configuration in which the temperature-sensitive magnetic member 114 is not heated and does not contact the fixing belt 102, a time until fixing for a first sheet P is able to be started is reduced; however, it is difficult to continuously perform fixing processing for plural sheets P.

In contrast, with the fixing device 100 in FIG. 2 and other drawings in which the temperature-sensitive magnetic member 114 is heated and contacts the fixing belt 102, as described above, the temperature-sensitive magnetic member 114 at a higher temperature than the temperature of the fixing belt 102 may contact the fixing belt 102 during the fixing processing. Accordingly, the heat is supplied to the fixing belt 102 with the temperature thereof decreased. Even when plural sheets P are continuously transported, the fixing processing may be performed for the sheets P.

With the fixing device 100 shown in FIG. 16, it is difficult to perform the fixing processing at a high speed because the temperature of the fixing belt 102 decreases. In contrast, with the fixing device 100 shown in FIG. 2 and other drawings, the heat is supplied during the fixing processing. The fixing processing may be performed at a high speed. Further, with the fixing device 100 shown in FIG. 2 and other drawings, the time until fixing becomes available is longer than the time of the fixing device 100 shown in FIG. 16 (as shown in FIG. 17, for example, 4 to 6 seconds). However, after the fixing processing is started, productivity may be increased, and entire productivity may be increased as compared with the fixing device 100 shown in FIG. 16. In the fixing device 100 shown in FIG. 2 and other drawings, as shown in FIG. 17, the fixing belt 102 and the temperature-sensitive magnetic member 114 are heated by a ratio of, for example, (7 to 8):(2 to 3).

Now, the slit formed in the temperature-sensitive magnetic member 114 is described with reference to FIGS. 18A and 18B.

Figure 18A:
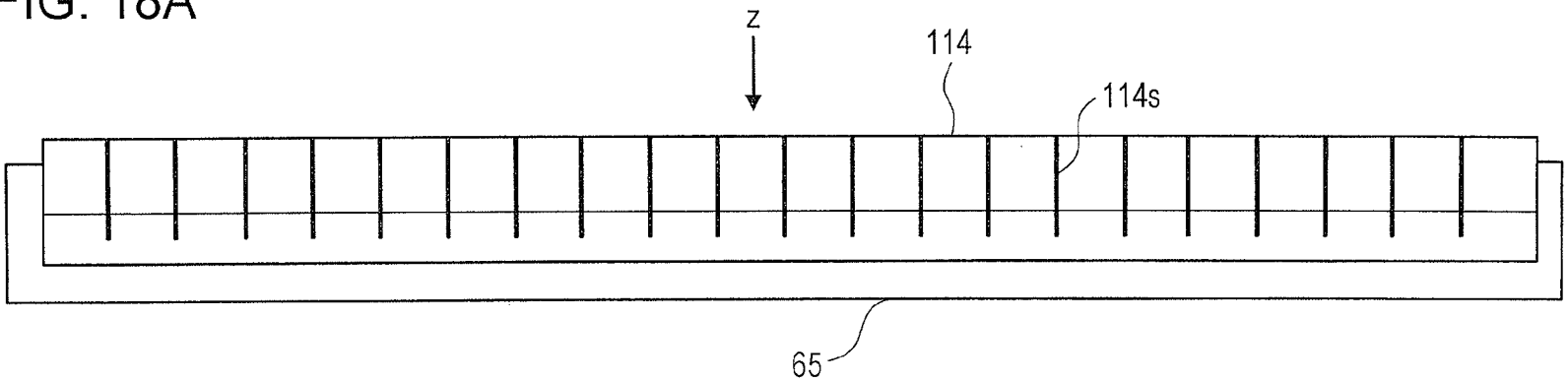
FIGS. 18A and 18B are illustrations showing slits formed in the temperature-sensitive magnetic member.
Figure 18B:
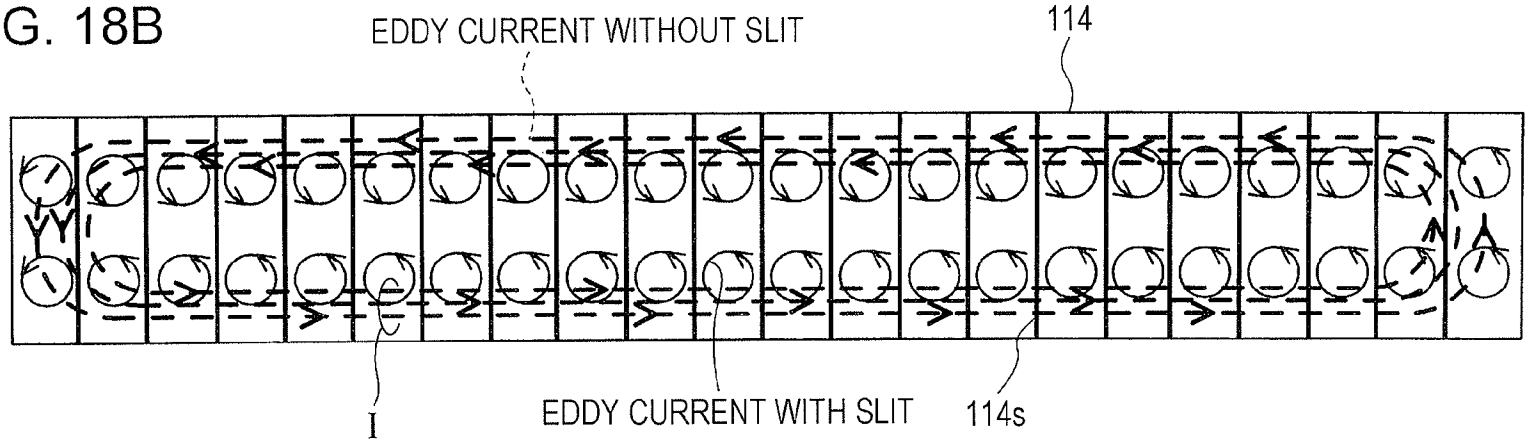

FIGS. 18A and 18B are illustrations showing slits formed in a temperature-sensitive magnetic member 114. FIG. 18A is a side view when the temperature-sensitive magnetic member 114 is mounted on a frame 65. FIG. 18B is a plan view from the upper side (in z direction) of FIG. 18A. Plural slits 114*s* are formed in the temperature-sensitive magnetic member 114 shown in FIG. 18A. The slits 114*s* are orthogonal to a direction in which eddy current I generated by magnetic force lines H flows. When the slits 114*s* are formed, the eddy current I, which flows in a form of a large eddy along the longitudinal direction of the temperature-sensitive magnetic member 114 if a slit 114*s* is not formed (see broken lines in FIG. 18B), is divided by the slits 114*s*.

In this case, the eddy current I flows through the temperature-sensitive magnetic member 114 in a form of small eddies each of which is arranged in a region between the slits 114*s* (see solid lines in FIG. 18B). The current amount of eddy current I is reduced. Consequently, the heat amount (Joule heat W) at the temperature-sensitive magnetic member 114 decreases and a configuration in which heat is hardly generated is provided. In the temperature-sensitive magnetic member 114 exemplarily shown in FIG. 18A has the slits 114*s* in the direction orthogonal to the direction in which the eddy current I flows. However, as long as the flow of the eddy current I is divided, slits inclined to the direction in which the eddy current I flows may be formed. Also, the slits 114*s* do not have to be formed in the entire region in the width direction of the temperature-sensitive magnetic member 114, and may be formed at part in the width direction of the temperature-sensitive magnetic member 114. The number, positions, inclination angle, etc., of the slits may be determined in accordance with the heat amount generated at the temperature-sensitive magnetic member 114.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device, comprising:

a fixing member that has a conductive layer capable of being heated by electromagnetic induction and fixes an image to the recording material;

a magnetic-field generator that generates an alternating magnetic field intersecting with the conductive layer of the fixing member;

a heating member that is at least partly separated from the fixing member and is heated; and a deformable member that is deformed when receiving heat and moves the heating member toward the fixing member.

2. The fixing device according to claim 1, wherein the heating member is heated by the alternating magnetic field generated by the magnetic-field generator.

3. The fixing device according to claim 1, wherein the deformable member is deformed when receiving heat from the heating member.

4. The fixing device according to claim 1, wherein the fixing member is substantially cylindrical, and wherein the deformable member is arranged inside the substantially cylindrical fixing member.

5. The fixing device according to claim 1, wherein the deformable member expands toward the fixing member and moves the heating member toward the fixing member.

6. The fixing device according to claim 1, wherein the deformable member is curved when receiving the heat and moves the heating member toward the fixing member by using a portion of the deformable member, the portion being displaced when the deformable member is curved.

7. The fixing device according to claim 1, wherein the fixing member and the heating member are separated from each other before the deformable member is deformed.

8. The fixing device according to claim 1, wherein the deformable member is formed of a shape memory alloy.

9. A heating device, comprising:

a supply member that has a conductive layer capable of being heated by electromagnetic induction and supplies heat to a member to be heated;

a magnetic-field generator that generates an alternating magnetic field intersecting with the conductive layer of the supply member;

a heating member that is at least partly separated from the supply member and is heated; and a deformable member that is deformed when receiving heat and moves the heating member toward the supply member.

10. An image forming apparatus, comprising:

an image forming unit that forms an image on a recording material;

a fixing member that has a conductive layer capable of being heated by electromagnetic induction and fixes the image formed by the image forming unit to the recording material;

a magnetic-field generator that generates an alternating magnetic field intersecting with the conductive layer of the fixing member;

a heating member that is at least partly separated from the fixing member and is heated; and a deformable member that is deformed when receiving heat and moves the heating member toward the fixing member.

* * * * *